US011472649B2

(12) United States Patent
Umi et al.

(10) Patent No.: US 11,472,649 B2
(45) Date of Patent: Oct. 18, 2022

(54) MEDIUM CONVEYING APPARATUS FOR CONTROLLING FEEDING A MEDIUM

(71) Applicant: PFU LIMITED, Kahoku (JP)

(72) Inventors: Takayuki Umi, Kahoku (JP); Shigeharu Okano, Kahoku (JP)

(73) Assignee: PFU LIMITED, Kahoku (JP)

( * ) Notice: Subject to any disclaimer, the term of this patent is extended or adjusted under 35 U.S.C. 154(b) by 361 days.

(21) Appl. No.: 16/667,787

(22) Filed: Oct. 29, 2019

(65) Prior Publication Data

US 2020/0299088 A1 Sep. 24, 2020

(30) Foreign Application Priority Data

Mar. 20, 2019 (JP) ..... JP2019-053442

(51) Int. Cl.
*B65H 7/12* (2006.01)
*B65H 3/52* (2006.01)

(52) U.S. Cl.
CPC ..... *B65H 7/12* (2013.01); *B65H 3/5284* (2013.01); *B65H 2511/524* (2013.01); *B65H 2515/34* (2013.01)

(58) Field of Classification Search
CPC .. B65H 7/12; B65H 3/5284; B65H 2511/524; B65H 2515/34
See application file for complete search history.

(56) References Cited

U.S. PATENT DOCUMENTS 5,597,155 A 1/1997 Guido et al.
6,059,285 A 5/2000 Suga et al.
7,234,695 B2 * 6/2007 Tsukamoto ..... B65H 3/06 271/262
7,481,421 B2 * 1/2009 Tsukamoto ..... B65H 3/5261 271/258.01
7,896,342 B2 * 3/2011 Tsukamoto ..... B65H 3/5261 271/262
8,678,372 B2 * 3/2014 Yasukawa ..... B65H 7/12 271/10.09
10,040,651 B2 * 8/2018 Satake ..... B65H 3/5261
(Continued)

FOREIGN PATENT DOCUMENTS

JP S63-180635 A 7/1988
JP 03249039 A * 11/1991
(Continued)

OTHER PUBLICATIONS

Japanese Office Action for JP Application No. 2019-053522 dated Jul. 11, 2022, 8 pages.

*Primary Examiner* — Patrick Cicchino
(74) *Attorney, Agent, or Firm* — Lewis Roca Rothgerber Christie LLP

(57) ABSTRACT

A medium conveying apparatus includes a medium tray, a feed roller to feed a medium placed on the medium tray, a brake roller facing the feed roller, a pressing member to press the brake roller to the feed roller side, a processor to detect media multi-feed, and control the feed roller and the brake roller in such a way that the medium is reset to the medium tray when the media multi-feed of media is detected. The processor controls the pressing member in such a way that a pressing force of the brake roller when resetting the medium to the medium tray is greater than a pressing force of the brake roller when feeding the medium.

20 Claims, 24 Drawing Sheets

(56) References Cited

U.S. PATENT DOCUMENTS

| | | | | |
|---|---|---|---|---|
| 2012/0113488 | A1 | 5/2012 | Machida et al. | |
| 2013/0234387 | A1 | 9/2013 | Moto | |
| 2013/0241145 | A1 | 9/2013 | Yasukawa | |
| 2017/0210582 | A1 | 7/2017 | Okano | |
| 2018/0115669 | A1 | 4/2018 | Ichimaru et al. | |
| 2020/0198912 | A1* | 6/2020 | Okano ..... | B65H 3/063 |

FOREIGN PATENT DOCUMENTS

| | | | |
|---|---|---|---|
| JP | 5-286611 | A | 11/1993 |
| JP | 7-215499 | A | 8/1995 |
| JP | 11-20993 | A | 1/1999 |
| JP | 11-193141 | A | 7/1999 |
| JP | 2000-247496 | A | 9/2000 |
| JP | 2012-111565 | A | 6/2012 |
| JP | 2013-173620 | A | 9/2013 |
| JP | 2013-184819 | A | 9/2013 |
| JP | 2013-193837 | A | 9/2013 |
| JP | 2018-65685 | A | 4/2018 |
| WO | WO 2016/056138 | A1 | 4/2016 |

* cited by examiner

MEDIUM CONVEYING APPARATUS FOR CONTROLLING FEEDING A MEDIUM

CROSS-REFERENCE TO RELATED APPLICATIONS

This application is based upon and claims the benefit of priority of prior Japanese Patent Application No. 2019-053442, filed on Mar. 20, 2019, the entire contents of which are incorporated herein by reference.

TECHNICAL FIELD

Embodiments discussed in the present specification relate to medium conveyance.

BACKGROUND

A medium conveying apparatus such as a scanner generally has a function of detecting whether or not multi-feed, that is, a plurality of media being conveyed in an overlapping manner is occurring. When media multi-feed occurs in such a medium conveying apparatus, a user needs to take out the media from a housing and reset the media to a medium tray. In order to improve user convenience, it is desired that when media multi-feed occurs in a medium conveying apparatus, the media be automatically restored to a loading tray.

An image reading device for conveying documents in a reverse direction and subsequently conveying the documents in a document conveying direction, when multi-feed of the documents is detected, is disclosed (see Japanese Unexamined Patent Publication (Kokai) No. 2018-65685). When multi-feed of documents is detected, the image reading device reduces a pressure load of a retard roller on a separation roller compared with before the multi-feed of the documents is detected.

A medium feeding device including a separating force generation device that causes a brake roller to generate a rotation load in a direction opposite to a conveying direction and increasing the rotation load when multi-feed of media is detected is disclosed (see Japanese Unexamined Patent Publication (Kokai) No. 2013-193837).

A sheet material feeding device for increasing idle running torque of a retard roller compared with a case of sheet materials not being multi-fed, when sheet materials are multi-fed at a clamping part of a feed roller and the retard roller, is disclosed (see Japanese Unexamined Patent Publication (Kokai) No. 11-193141).

SUMMARY

According to some embodiments, a medium conveying apparatus includes a medium tray, a feed roller to feed a medium placed on the medium tray, a brake roller facing the feed roller, a pressing member to press the brake roller to the feed roller side, a processor to detect media multi-feed, and control the feed roller and the brake roller in such a way that the medium is reset to the medium tray when the media multi-feed is detected. The processor controls the pressing member in such a way that a pressing force of the brake roller when resetting the medium to the medium tray is greater than a pressing force of the brake roller when feeding the medium.

According to some embodiments, a method for controlling feeding a medium, includes feeding a medium placed on a medium tray by a feed roller, pressing a brake roller facing the feed roller to the feed roller side by a pressing member, detecting media multi-feed, controlling the feed roller and the brake roller in such a way that a fed medium is reset to the medium tray when the media multi-feed is detected, and controlling the pressing member in such a way that a pressing force of the brake roller when resetting the medium to the medium tray is greater than a pressing force of the brake roller when feeding the medium.

According to some embodiments, a computer program causes a medium conveying apparatus including a medium tray, a feed roller to feed a medium placed on the medium tray, a brake roller facing the feed roller, and a pressing member to press the brake roller to the feed roller side, to execute a process including detecting media multi-feed, controlling the feed roller and the brake roller in such a way that the medium is reset to the medium tray when the media multi-feed is detected, and controlling the pressing member in such a way that a pressing force of the brake roller when resetting the medium to the medium tray is greater than a pressing force of the brake roller when feeding the medium.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
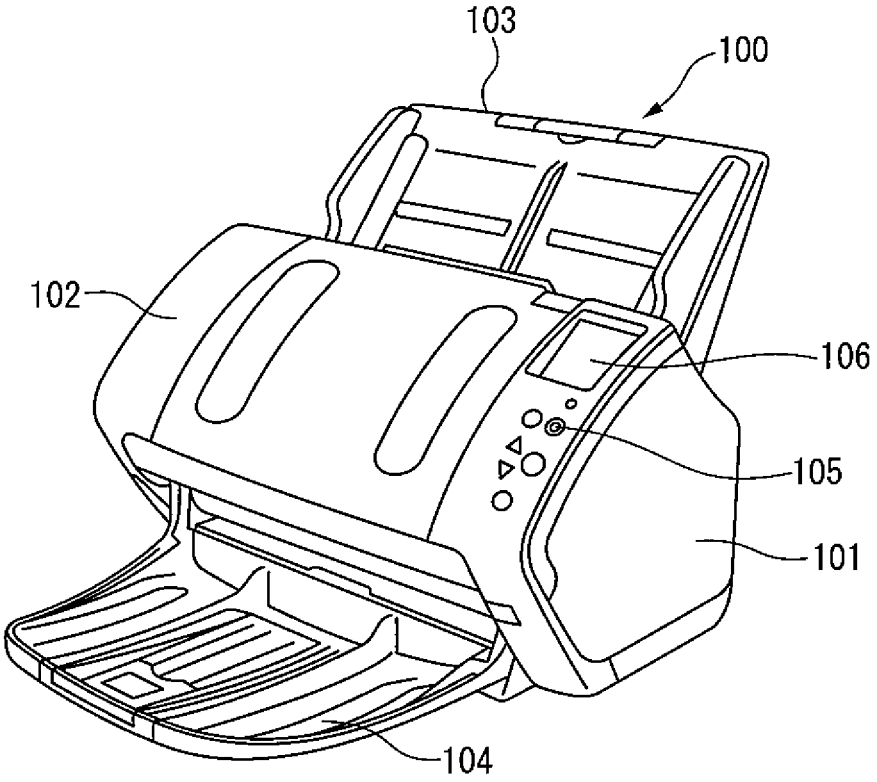
FIG. 1 is a perspective view illustrating a medium conveying apparatus 100 according to an embodiment.

FIG. 1 is a perspective view illustrating a medium conveying apparatus 100 configured as an image scanner. The medium conveying apparatus 100 conveys and images a medium being a document. A medium is paper, thick paper, a card, a brochure, a passport, etc. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, an ejection tray 104, an operation device 105, and a display device 106.

The upper housing 102 is an example of an upper part of a housing, is located in a position covering a top surface of the medium conveying apparatus 100, and is engaged with the lower housing 101 by a hinge in such a way as to be able to open and close in a case of a medium being stuck, cleaning inside the medium conveying apparatus 100, etc.

The medium tray 103 is formed by a resin member and is engaged with the lower housing 101 in such a way as to be able to place a medium to be conveyed. The medium tray 103 is provided in such a way that a placement surface 103*a* of a medium is tilted against an installation surface of the medium conveying apparatus 100. The ejection tray 104 is engaged with the lower housing 101 in such a way as to be able to hold an ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

Figure 2:
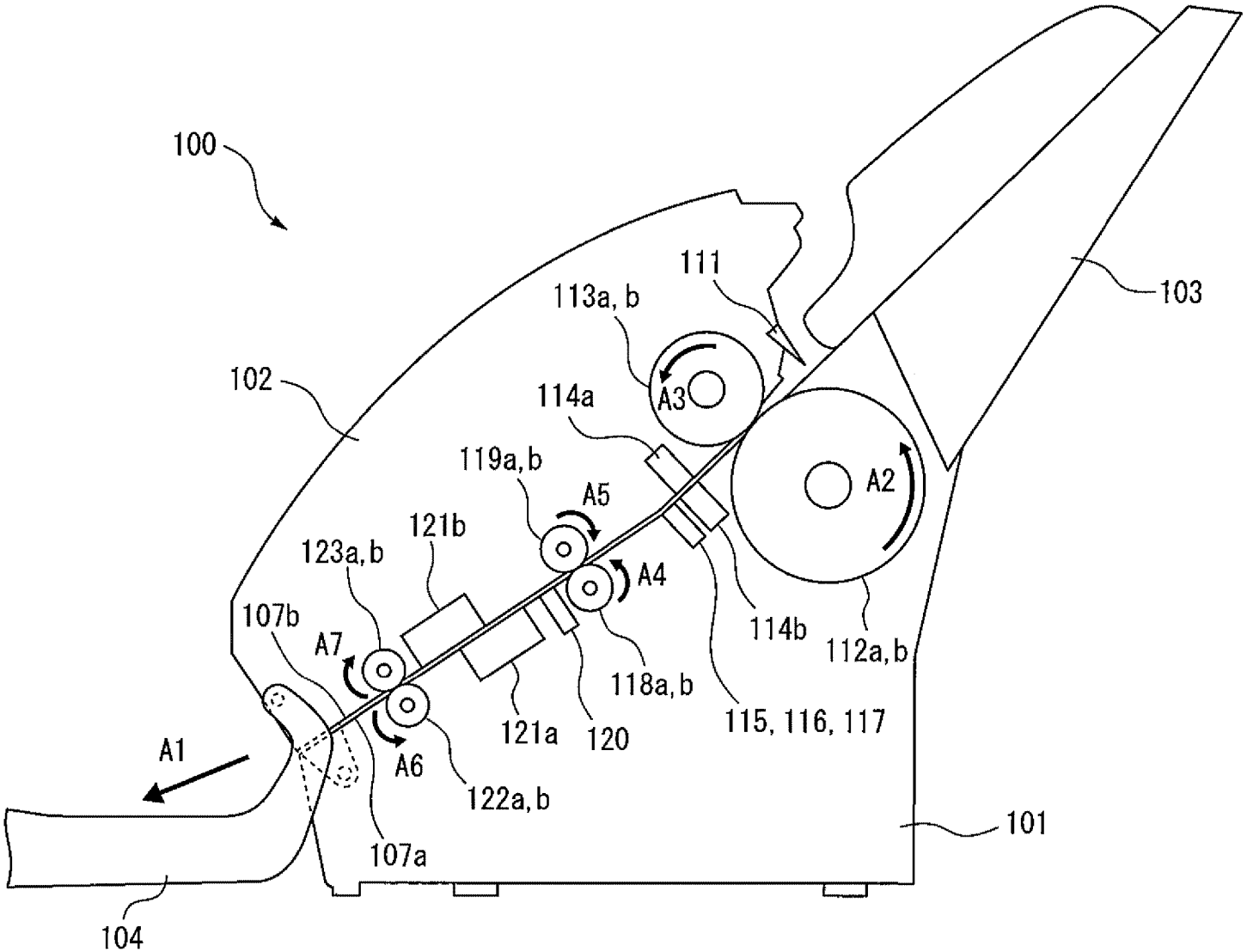
FIG. 2 is a diagram for illustrating a conveyance path inside the medium conveying apparatus 100.

FIG. 2 is a diagram for illustrating a conveyance path inside the medium conveying apparatus 100.

The conveyance path inside the medium conveying apparatus 100 includes a medium detection sensor 111, a plurality of feed rollers 112*a* and 112*b*, a plurality of brake rollers 113*a* and 113*b*, an ultrasonic transmitter 114*a*, an ultrasonic receiver 114*b*, a first center sensor 115, a first side sensor 116, a second side sensor 117, a plurality of first conveyance rollers 118*a* and 118*b*, a plurality of second conveyance rollers 119*a* and 119*b*, a second center sensor 120, a first imaging device 121*a*, a second imaging device 121*b*, a plurality of third conveyance rollers 122*a* and 122*b*, and a plurality of fourth conveyance rollers 123*a* and 123*b*, etc.

The feed rollers 112*a* and 112*b* may be hereinafter collectively referred to as feed rollers 112. Further, the brake rollers 113*a* and 113*b* may be collectively referred to as brake rollers 113. Further, the first conveyance rollers 118*a* and 118*b* may be collectively referred to as first conveyance rollers 118. Further, the second conveyance rollers 119*a* and 119*b* may be collectively referred to as second conveyance rollers 119. Further, the first imaging device 121*a* and the second imaging device 121*b* may be collectively referred to as imaging devices 121. Further, the third conveyance rollers 122*a* and 122*b* may be collectively referred to as third conveyance rollers 122. Further, the fourth conveyance rollers 123*a* and 123*b* may be collectively referred to as fourth conveyance rollers 123.

A top surface of the lower housing 101 forms a lower guide 107*a* of a conveyance path of a medium, and a bottom surface of the upper housing 102 forms an upper guide 107*b* of the conveyance path of a medium. An arrow A1 in FIG. 2 indicates a medium conveying direction. An upstream hereinafter refers to an upstream in the medium conveying direction A1, and a downstream refers to a downstream in the medium conveying direction A1.

The medium detection sensor 111 is located on the upstream side of the feed rollers 112 and the brake rollers 113. The medium detection sensor 111 includes a contact detection sensor and detects whether or not a medium is placed on the medium tray 103. The medium detection sensor 111 generates and outputs a medium detection signal changing the signal value between a state in which a medium is placed on the medium tray 103 and a state in which a medium is not placed.

The feed rollers 112 are provided on the lower housing 101 and sequentially feed media placed on the medium tray 103 from the lower side. The brake rollers 113 are provided on the upper housing 102 and each of the plurality of brake rollers 113 is located to face a corresponding one of the feed rollers 112.

The ultrasonic transmitter 114*a* and the ultrasonic receiver 114*b* are located on the downstream side of the feed rollers 112 and the brake rollers 113. The ultrasonic transmitter 114*a* and the ultrasonic receiver 114*b* are located close to the conveyance path of a medium in such a way as to face one another with the conveyance path in between. The ultrasonic transmitter 114*a* outputs an ultrasonic wave. On the other hand, the ultrasonic receiver 114*b* receives an ultrasonic wave being transmitted by the ultrasonic transmitter 114*a* and passing through a medium, and generates and outputs an ultrasonic signal being an electric signal corresponding to the received ultrasonic wave. The ultrasonic transmitter 114*a* and the ultrasonic receiver 114*b* may be hereinafter collectively referred to as an ultrasonic sensor 114.

The first imaging device 121*a* is an example of an imaging module and includes a reduction optical system type line sensor including an imaging element based on charge coupled devices (CCDs) linearly located in a main scanning direction. Further, the first imaging device 121*a* includes a lens for forming an image on the imaging element, and an A/D converter for amplifying and analog-digital (A/D) converting an electric signal output from the imaging element. The first imaging device 121*a* generates and outputs an input image imaging a back side of a conveyed medium, in accordance with control from a processing circuit to be described later.

Similarly, the second imaging device 121*b* is an example of an imaging module and includes a reduction optical system type line sensor including an imaging element based on CCDs linearly located in the main scanning direction. Further, the second imaging device 121*b* includes a lens for forming an image on the imaging element, and an A/D converter for amplifying and A/D converting an electric signal output from the imaging element. The second imaging device 121*b* generates and outputs an input image imaging a front side of a conveyed medium, in accordance with control from a processing circuit to be described later.

Only either of the first imaging device 121*a* and the second imaging device 121*b* may be located in the medium conveying apparatus 100 and only one side of a medium may be read. Further, a unity-magnification optical system type contact image sensor (CIS) including an imaging element based on a complementary metal oxide semiconductor (CMOS) may be used in place of the imaging element based on CCDs.

A medium placed on the medium tray 103 is conveyed between the lower guide 107*a* and the upper guide 107*b* in the medium conveying direction A1 by the feed rollers 112 rotating in a direction of an arrow A2 in FIG. 2, that is, a medium feeding direction. When a medium is conveyed, the brake rollers 113 rotate in a direction of an arrow A3, that is, a direction opposite to the medium feeding direction. By the workings of the feed rollers 112 and the brake rollers 113, when a plurality of media are placed on the medium tray 103, only a medium in contact with the feed rollers 112, out of the media placed on the medium tray 103, is separated. Consequently, the medium conveying apparatus 100 operates in such a way that conveyance of a medium other than the separated medium is restricted (prevention of media multi-feed).

A medium is fed between the first conveyance rollers 118 and the second conveyance rollers 119 while being guided by the lower guide 107*a* and the upper guide 107*b*. The medium is fed between the first imaging device 121*a* and the second imaging device 121*b* by the first conveyance rollers 118 and the second conveyance rollers 119 rotating in directions of an arrow A4 and an arrow A5, respectively. The first conveyance rollers 118 and the second conveyance rollers 119 are examples of conveyance rollers for conveying a medium fed by the feed rollers 112 to the imaging device 121. The medium read by the imaging devices 121 is ejected on the ejection tray 104 by the third conveyance rollers 122 and the fourth conveyance rollers 123 rotating in directions of an arrow A6 and an arrow A7, respectively.

Figure 3:
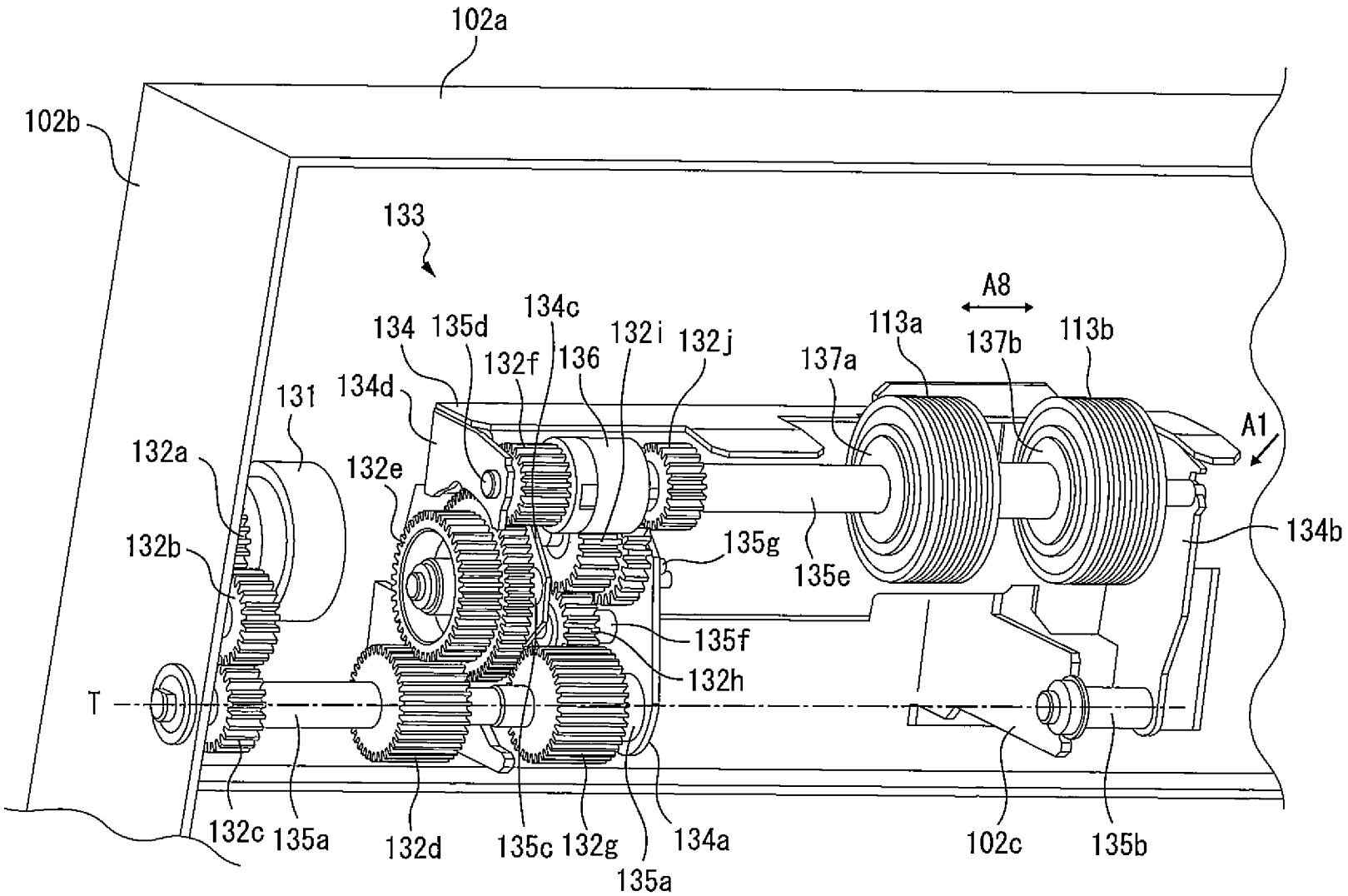
FIG. 3 is a schematic diagram for illustrating a driving mechanism of brake rollers 113.
Figure 4:
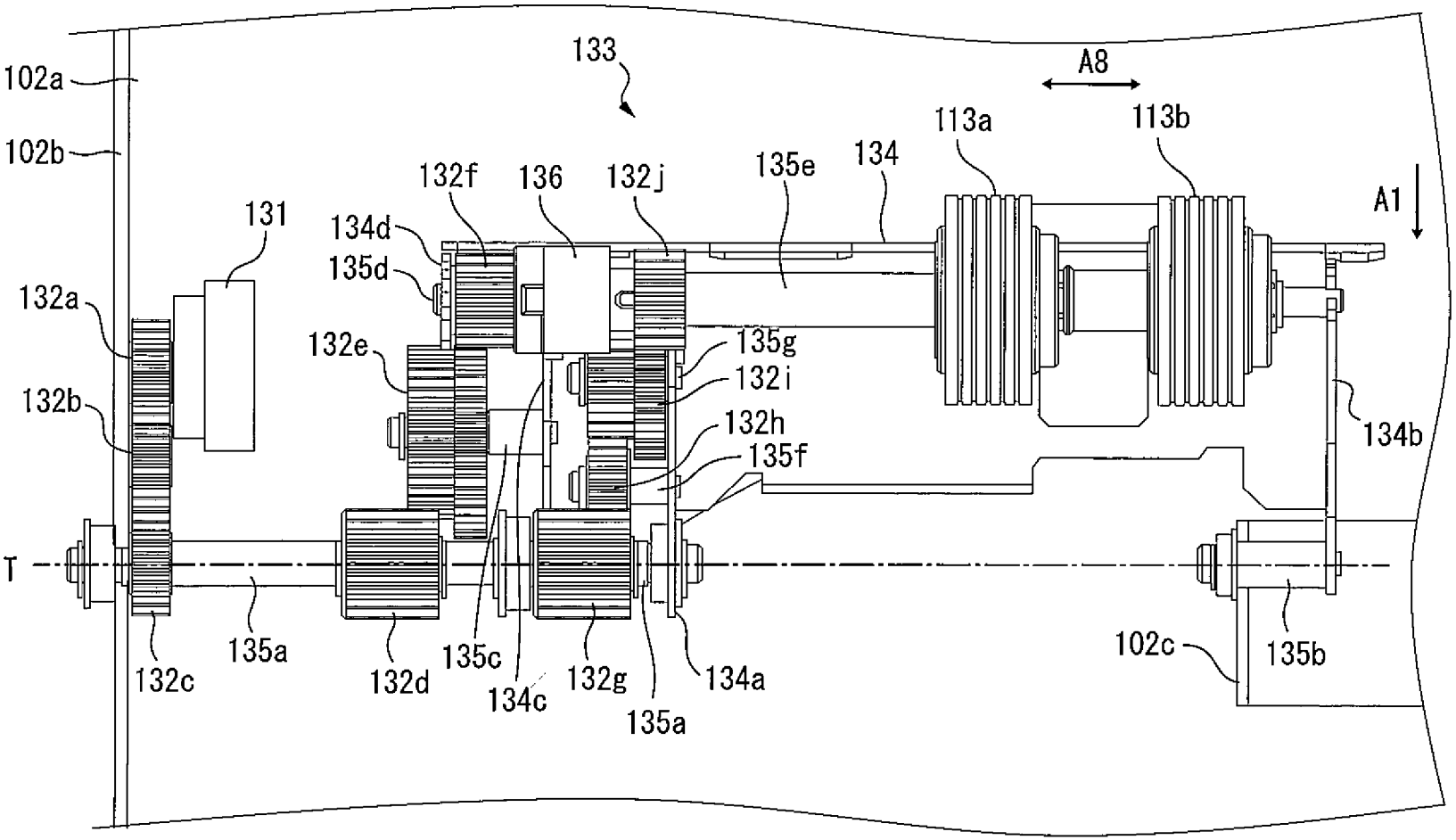
FIG. 4 is a schematic diagram for illustrating the driving mechanism of the brake rollers 113.

FIG. 3 and FIG. 4 are schematic diagrams for illustrating a driving mechanism of the brake rollers 113. FIG. 3 and FIG. 4 are a perspective view and a plan view of the driving mechanism of the brake rollers 113 viewed from the conveyance path side, respectively, in a state in which the upper guide 107*b* is removed.

As illustrated in FIG. 3 and FIG. 4, the driving mechanism of the brake rollers 113 includes a first motor 131, first and second transmission gears 132*a* and *b*, and a brake roller unit 133. The first motor 131 generates a driving force for rotating the brake rollers 113. Each transmission gear transmits a driving force from the first motor 131 to the brake rollers 113. The first transmission gear 132*a* is mounted on a rotation axis of the first motor 131, and the first transmission gear 132*a* is engaged with the second transmission gear 132*b*.

Figure 5:
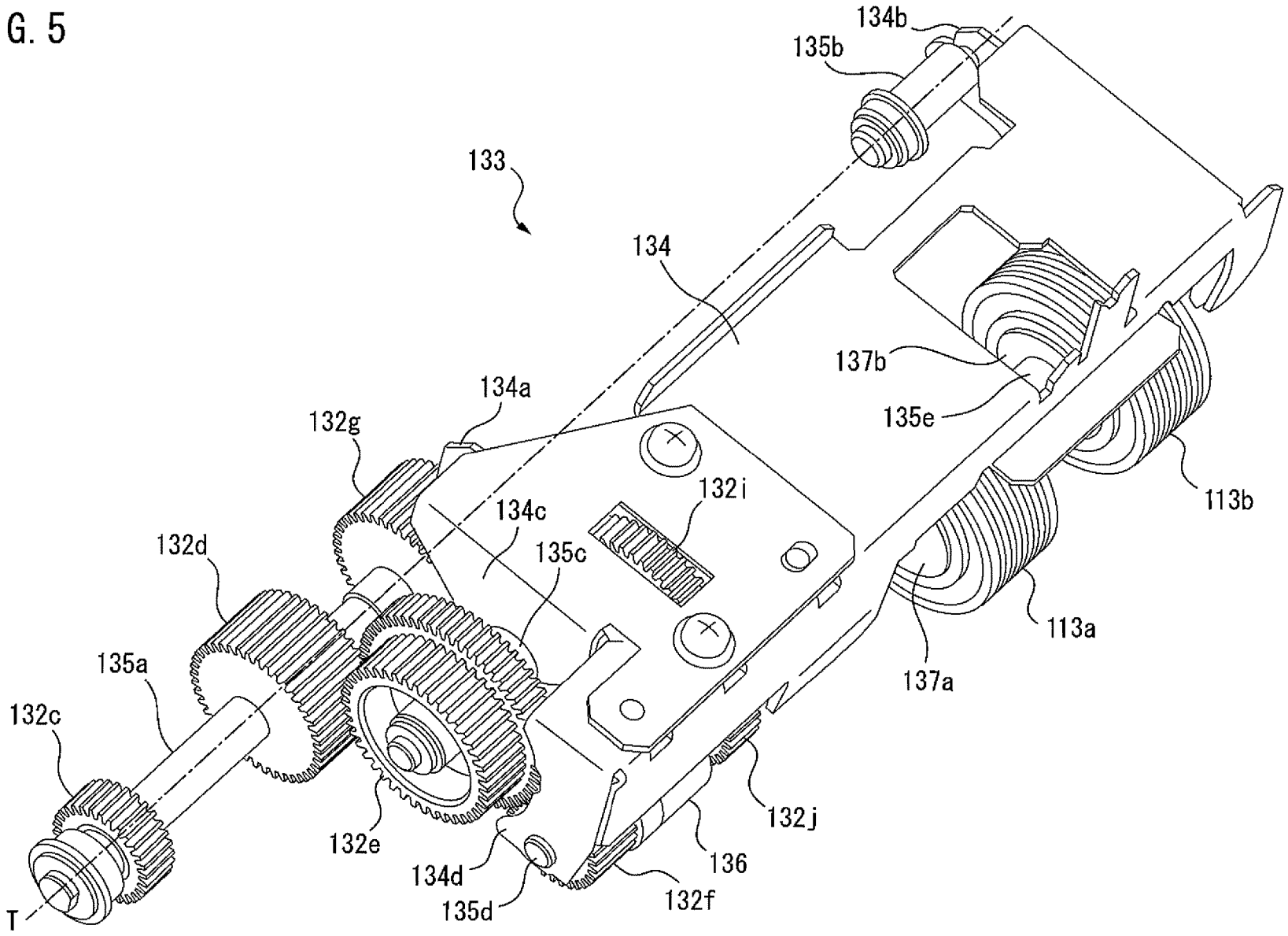
FIG. 5 is a perspective view of a brake roller unit 133.
Figure 6:
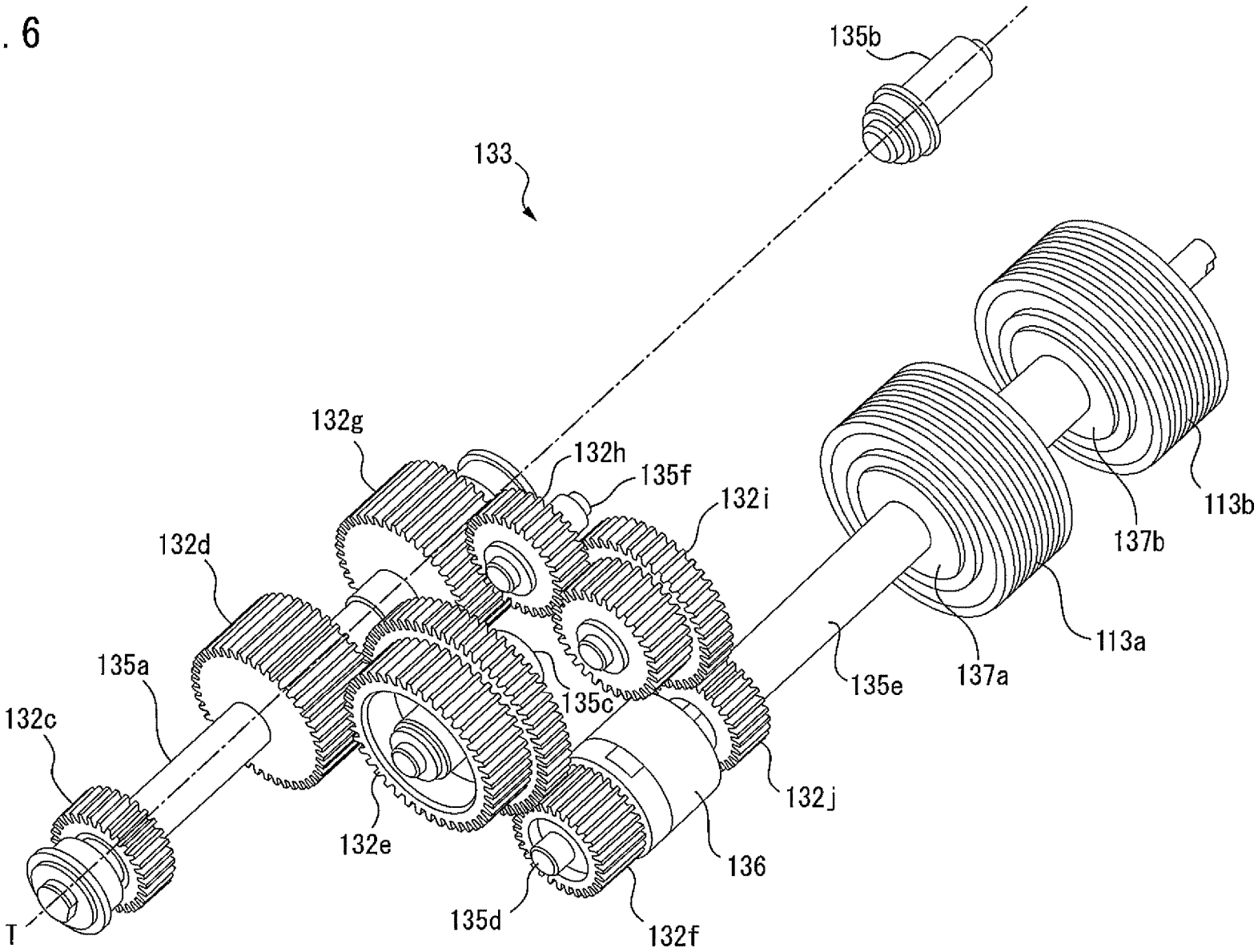
FIG. 6 is a perspective view of the brake roller unit 133.

FIG. 5 is a perspective view of the brake roller unit 133 in a state of being removed from the upper housing 102, viewed from above (opposite from the conveyance path). FIG. 6 is a perspective view of the brake roller unit 133 viewed from above in a state in which a support member 134 supporting the brake roller unit 133 is removed.

As illustrated in FIG. 3 to FIG. 6, the brake roller unit 133 includes third to tenth transmission gears 132*c* to *j*, the support member 134, first to seventh shafts 135*a* to *g*, a first torque limiter 136, and second torque limiters 137*a* and *b*.

The support member 134 is a member based on resin, metal, etc., includes first to fourth sides 134*a* to *d*, and supports the brake rollers 113, the third to tenth transmission gears 132*c* to *j*, the first torque limiter 136, and the second torque limiters 137*a* and *b*. As illustrated in FIG. 3 and FIG. 4, the first side 134*a* and the second side 134*b* are mounted on a first side 102*b* and a second side 102*c* of an internal housing 102*a* on the upper housing 102 through the first shaft 135*a* and the second shaft 135*b*, respectively. The first shaft 135*a* and the second shaft 135*b* are provided along a rotation axis T, and the support member 134 is supported by the internal housing 102*a* in such a way as to be rotatable (swingable) around the rotation axis T.

As illustrated in FIG. 3, FIG. 4, and FIG. 6, the third transmission gear 132*c* and the fourth transmission gear 132*d* are mounted on the first shaft 135*a*. The third transmission gear 132*c* is engaged with the second transmission gear 132*b*, and the fourth transmission gear 132*d* is engaged with a gear part of the fifth transmission gear 132*e* with a smaller outer diameter. The fifth transmission gear 132*e* is mounted on the third shaft 135*c*, and the third shaft 135*c* is mounted on the third side 134*c*. A gear part of the fifth transmission gear 132*e* with a larger outer diameter is engaged with the sixth transmission gear 132*f*. The sixth transmission gear 132*f* is mounted on the fourth shaft 135*d*, and the fourth shaft 135*d* is mounted on the fourth side 134*d*. The fourth shaft 135*d* is engaged with the fifth shaft 135*e* through the first torque limiter 136. The fifth shaft 135*e* is provided on the same axis as the fourth shaft 135*d* and is also engaged with the fourth side 134*d*. A torque limit value of the first torque limiter 136 is a first limit value.

The plurality of brake rollers 113*a* and 113*b* are mounted on the fifth shaft 135*e* in such a way as to rotate according to rotation of the fifth shaft 135*e*. The plurality of brake rollers 113*a* and 113*b* are spaced and located alongside in a direction A8 perpendicular to the medium conveying direction.

The plurality of second torque limiters 137*a* and 137*b* are separately provided between a corresponding one of the fifth shaft 135*e* being a rotation axis of the brake rollers 113 and a corresponding one of the brake rollers 113*a* and 113*b*, respectively. Specifically, the second torque limiters 137*a* and 137*b* are provided correspondingly to the brake rollers 113*a* and 113*b*, respectively. A torque limit value of each of the second torque limiters 137*a* and 137*b* is less than the first limit value, and the total of the torque limit values of the second torque limiters 137*a* and 137*b* is equal to a second limit value greater than the first limit value. For example, the first limit value is set to 500 gf. cm, the second limit value is set to 700 gf. cm, and the torque limit value of each of the second torque limiters 137*a* and 137*b* is set to 350 gf. cm. A common second torque limiter may be provided for the brake rollers 113*a* and 113*b*, rather than separate second torque limiters 137*a* and 137*b* being provided for the brake rollers 113*a* and 113*b*, respectively.

Thus, the first torque limiter 136 and the second torque limiters 137*a* and 137*b* are provided on the fifth shaft 135*e* being a rotation axis of the brake rollers 113. A gear does not exist between each torque limiter and the brake rollers 113, and therefore fluctuation of a separating force provided for the brake rollers 113 due to a manufacturing error for each part, etc., is suppressed. Consequently, the medium conveying apparatus 100 can separate a medium with high precision regardless of a manufacturing error for each part.

Further, the seventh transmission gear 132*g* is mounted on the first shaft 135*a*. The seventh transmission gear 132*g* is engaged with the eighth transmission gear 132*h*. The eighth transmission gear 132*h* is mounted on the sixth shaft 135*f*, and the sixth shaft 135*f* is mounted on the first side 134*a*. The eighth transmission gear 132*h* is engaged with a gear part of the ninth transmission gear 132*i* with a smaller outer diameter. The ninth transmission gear 132*i* is mounted on the seventh shaft 135*g*, and the seventh shaft 135*g* is mounted on the first side 134*a*. A gear part of the ninth transmission gear 132*i* with a larger outer diameter is engaged with the tenth transmission gear 132*j*. The tenth transmission gear 132*j* is mounted on the fifth shaft 135*e*.

Figure 7:
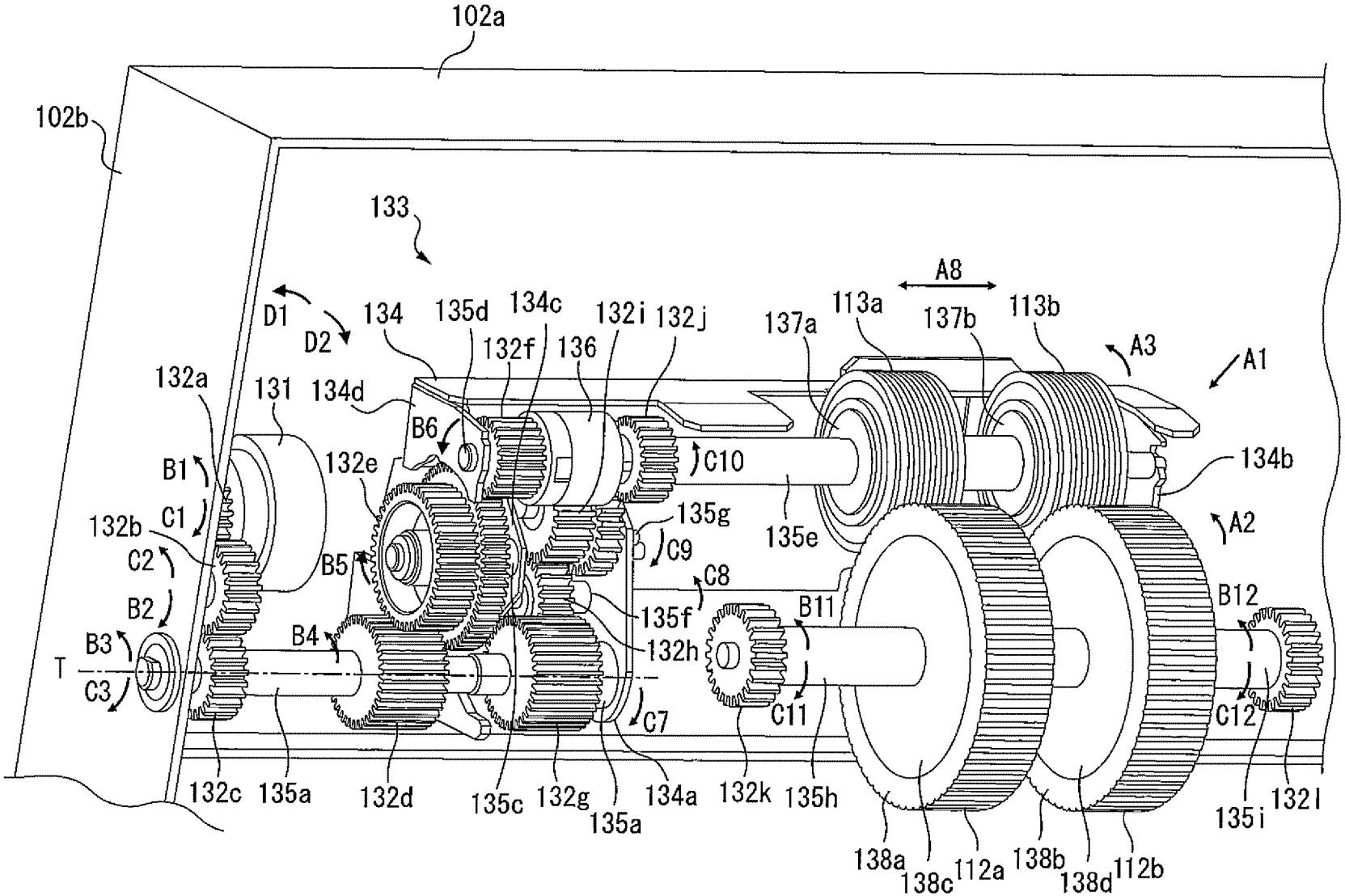
FIG. 7 is a schematic diagram for illustrating a driving mechanism of feed rollers 112, etc.

FIG. 7 is a schematic diagram for illustrating a driving mechanism of the feed rollers 112 and an operation of the feed rollers 112 and the brake rollers 113. FIG. 7 is a perspective view of the driving mechanism of the brake roller unit 133 illustrated in FIG. 3 added with the driving mechanism of the feed rollers 112.

As illustrated in FIG. 7, the plurality of feed rollers 112*a* and 112*b* are spaced and located alongside in the direction A8 perpendicular to the medium conveying direction at positions facing the plurality of brake rollers 113*a* and 113*b*, respectively. The feed rollers 112*a* and 112*b* are provided with outer peripheral surfaces 138*a* and 138*b*, one-way clutches 138*c* and 138*d*, etc., respectively. The one-way clutches 138*c* and 138*d* prevent the respective outer peripheral surfaces 138*a* and 138*b* of the feed rollers 112*a* and 112*b* from rotating in a direction opposite to the medium feeding direction A2 with respect to respective rotation axis of the feed rollers 112*a* and 112*b*. The driving mechanism of the feed rollers 112 includes eleventh and twelfth transmission gears 132*k* and *l*, and eighth and ninth shafts 135*h* and *i*.

The first conveyance rollers 118 and the second conveyance rollers 119 convey a medium at a conveyance speed faster than a feed speed of the feed rollers 112. Accordingly, when a medium reaches a position of the first conveyance rollers 118 and the second conveyance rollers 119, the medium is pulled by the first conveyance rollers 118 and the second conveyance rollers 119 while being clamped by the feed rollers 112 and the brake rollers 113. At this time, the outer peripheral surfaces 138*a* and 138*b* of the feed rollers 112 rotate according to the clamped medium by the workings of the one-way clutches 138*c* and 138*d*, and therefore do not hamper conveyance of the medium.

The eleventh transmission gear 132*k* is connected to the first motor 131 through a predetermined driving mechanism. The eleventh transmission gear 132*k* may be connected to a motor separate from the first motor 131 and may be driven by the separate motor. The eleventh transmission gear 132*k* is mounted at one end of the eighth shaft 135*h*, and the feed roller 112*a* is mounted at the other end of the eighth shaft 135*h* in such a way as to rotate according to rotation of the eighth shaft 135*h*.

The twelfth transmission gear 132*l* is connected to a second motor (unillustrated) separate from the first motor 131 through a predetermined driving mechanism. In other words, the feed rollers 112*a* and 112*b* are provided in such a way as to rotate independently at a respective circumferential speed to feed a medium by separate motors, respectively. The feed rollers 112*a* and 112*b* may be provided in such a way as to rotate integrally by a common motor. The twelfth transmission gear 132*l* is mounted at one end of the ninth shaft 135*i*, and the feed roller 112*b* is mounted at the other end of the ninth shaft 135*i* in such a way as to rotate according to rotation of the ninth shaft 135*i*.

The first motor 131 generates a first driving force by rotation in a first direction and also generates a second driving force by rotation in a second direction opposite to the first direction, as driving forces. Rotation in the first direction refers to rotation of rotating the first transmission gear 132*a* in a direction of an arrow B1, and rotation in the second direction refers to rotation of rotating the first transmission gear 132*a* in a direction C1, that is, a direction opposite to the arrow B1. Similarly, the second motor connected to the twelfth transmission gear 132*l* generates the first driving force by rotation in the first direction and generates the second driving force by rotation in the second direction opposite to the first direction, as driving forces.

When the first motor 131 generates the first driving force, the first transmission gear 132*a* rotates in the direction of an arrow B1, and the second to sixth transmission gears 132*b* to *f* accordingly rotate in directions of arrows B2 to B6, respectively. Consequently, the brake rollers 113*a* and 113*b* rotate in the direction A3 opposite to the medium feeding direction. The seventh transmission gear 132*g* is provided with a one-way clutch in such a way that the seventh transmission gear 132*g* does not rotate according to rotation of the first shaft 135*a* when the first shaft 135*a* rotates in a direction of an arrow B3. Consequently, the first driving force is not transmitted through the seventh to ninth transmission gears 132*g* to *i*. Further, when the first motor 131 generates the first driving force, the feed roller 112*a* rotates in the medium feeding direction A2 by the eleventh transmission gear 132*k* rotating in a direction of an arrow B11. Similarly, when the second motor generates the first driving force, the feed roller 112*b* rotates in the medium feeding direction A2 by the twelfth transmission gear 132*l* rotating in a direction of an arrow B12.

On the other hand, when the first motor 131 generates the second driving force, the first transmission gear 132*a* rotates in a direction of an arrow C1, and the second, third, and seventh to tenth transmission gears 132*b, c*, and *g* to *j* accordingly rotate in directions of arrows C2, C3, and C7 to C10, respectively. Consequently, the brake rollers 113*a* and 113*b* rotate in the direction A3 opposite to the medium feeding direction. The fourth transmission gear 132*d* is provided with a one-way clutch in such a way that the fourth transmission gear 132*d* does not rotate according to rotation of the first shaft 135*a* when the first shaft 135*a* rotates in the direction of the arrow C3. Consequently, the second driving force is not transmitted through the fourth to sixth transmission gears 132*d* to *f*. Further, when the first motor 131 generates the second driving force, the eleventh transmission gear 132*k* and the eighth shaft 135*h* rotate in a direction of an arrow C11; however, by the working of the one-way clutch 138*c*, the outer peripheral surface 138*a* of the feed roller 112*a* does not rotate according to the second driving force. Similarly, when the second motor generates the second driving force, the twelfth transmission gear 132*l* and the ninth shaft 135*i* rotate in a direction of an arrow C12; however, by the working of the one-way clutch 138*d*, the outer peripheral surface 138*b* of the feed roller 112*b* does not rotate according to the second driving force.

Further, when the first motor 131 generates the first driving force, a force toward the direction of the arrow B4 is applied to the fifth transmission gear 132*e* by the fourth transmission gear 132*d* rotating in the direction of the arrow B4. Consequently, a force rotating in the direction of the arrow 134 around a position where the first shaft 135*a* mounted with the fourth transmission gear 132*d* is engaged is applied to the third side 134*c* mounted with the fifth transmission gear 132*e*. Consequently, a force rotating around the rotation axis T in a direction of an arrow D1 is applied to the support member 134, and a force in a direction separating from the feed rollers 112 (the direction of the arrow D1) is applied to the brake rollers 113.

On the other hand, when the first motor 131 generates the second driving force, a force toward the direction of the arrow C7 is applied to the eighth transmission gear 132*h* by the seventh transmission gear 132*g* rotating in the direction of the arrow C7. Consequently, a force rotating in the direction of the arrow C7 around a position where the first shaft 135*a* mounted with the seventh transmission gear 132*g* is engaged is applied to the first side 134*a* mounted with the eighth transmission gear 132*h*. Consequently, a force rotating around the rotation axis T in a direction of an arrow D2 is applied to the support member 134, and a force in a direction toward the feed rollers 112 (the direction of the arrow D2) is applied to the brake rollers 113.

Thus, the brake roller unit 133 is an example of a pressing member and presses the brake rollers 113 to the feed rollers 112 side. The fourth to sixth transmission gears 132*c* to *e* are examples of a first transmission mechanism, and transmit the first driving force from the first motor 131 to the brake rollers 113 and rotate the brake rollers 113 in the direction A3 opposite to the medium feeding direction. The fourth transmission gear 132*d* is an example of a first gear and rotates in the direction of the arrow B4. The direction of the arrow B4 is an example of a first direction. The fifth transmission gear 132*e* is an example of a second gear and applies a force in the direction of the arrow B4 to the brake rollers 113 according to rotation of the fourth transmission gear 132*d*.

On the other hand, the seventh to tenth transmission gears 132*g* to *j* are an example of a second transmission mechanism, and transmit the second driving force from the first motor 131 to the brake rollers 113 and rotate the brake rollers 113 in the direction A3 opposite to the medium feeding direction. The seventh transmission gear 132*g* is an example of a third gear and rotates in the direction of the arrow C7. The direction of the arrow C7 is a direction opposite to the direction of the arrow B4 and is an example of a second direction. The eighth transmission gear 132*h* is an example of a fourth gear and applies a force in the direction of the arrow C7 to the brake rollers 113 according to rotation of the seventh transmission gear 132*g*.

The first transmission mechanism transmits the first driving force to the brake rollers 113 through the first torque limiter 136 provided on the fourth shaft 135*d* being a rotation axis of the sixth transmission gear 132*f*. On the other hand, the second transmission mechanism transmits the second driving force to the brake rollers 113 bypassing the first torque limiter 136 and also through the second torque limiters 137*a* and 137*b*.

Regardless of which of the first transmission mechanism and the second transmission mechanism is used, each driving force is transmitted to the brake rollers 113 through the second torque limiters 137*a* and 137*b*. However, the torque limit value (the first limit value) of the first torque limiter 136 is less than the total of the torque limit values (the second limit value) of the second torque limiters 137*a* and 137*b*. Accordingly, the total torque limit value of the first transmission mechanism going through both the first torque limiter 136 and the second torque limiters 137*a* and 137*b* becomes the first limit value. On the other hand, the total torque limit value of the second transmission mechanism going through only the second torque limiters 137*a* and 137*b* and bypassing the first torque limiter 136 becomes the second limit value. In other words, while the brake rollers 113 rotate in the direction A3 opposite to the medium feeding direction regardless of whether being driven by the first driving force or the second driving force, the torque limit value in the case of being driven by the second driving force is greater than the torque limit value in the case of being driven by the first driving force.

The first limit value is set to a value by which a turning force through the first torque limiter 136 is cut off when there is one medium, and a turning force through the first torque limiter 136 is transmitted when there are a plurality of media. Consequently, when only one medium is conveyed, the brake rollers 113 do not rotate according to the first driving force and are driven by the feed rollers 112. On the other hand, when a plurality of media are conveyed, the brake rollers 113 prevents occurrence of media multi-feed by rotating in the direction A3 opposite to the medium feeding direction and separating a medium in contact with the feed rollers 112 from the other media. At this time, the outer peripheral surfaces of the brake rollers 113 may be apply a force in the direction A3 opposite to the medium feeding direction to the media in a state in which the outer peripheral surfaces are not rotating in the direction A3 opposite to the medium feeding direction and are stopped.

On the other hand, the second limit value is set to a value by which a turning force through the second torque limiters 137*a* and 137*b* is transmitted even when there are a plurality of media. Accordingly, when the first motor 131 generates the second driving force, the brake rollers 113 rotate in the direction A3 opposite to the medium feeding direction according to the second driving force, reset a medium existing between the brake rollers 113 and the feed rollers 112 to the medium tray 103, and restore the medium.

Figure 8:
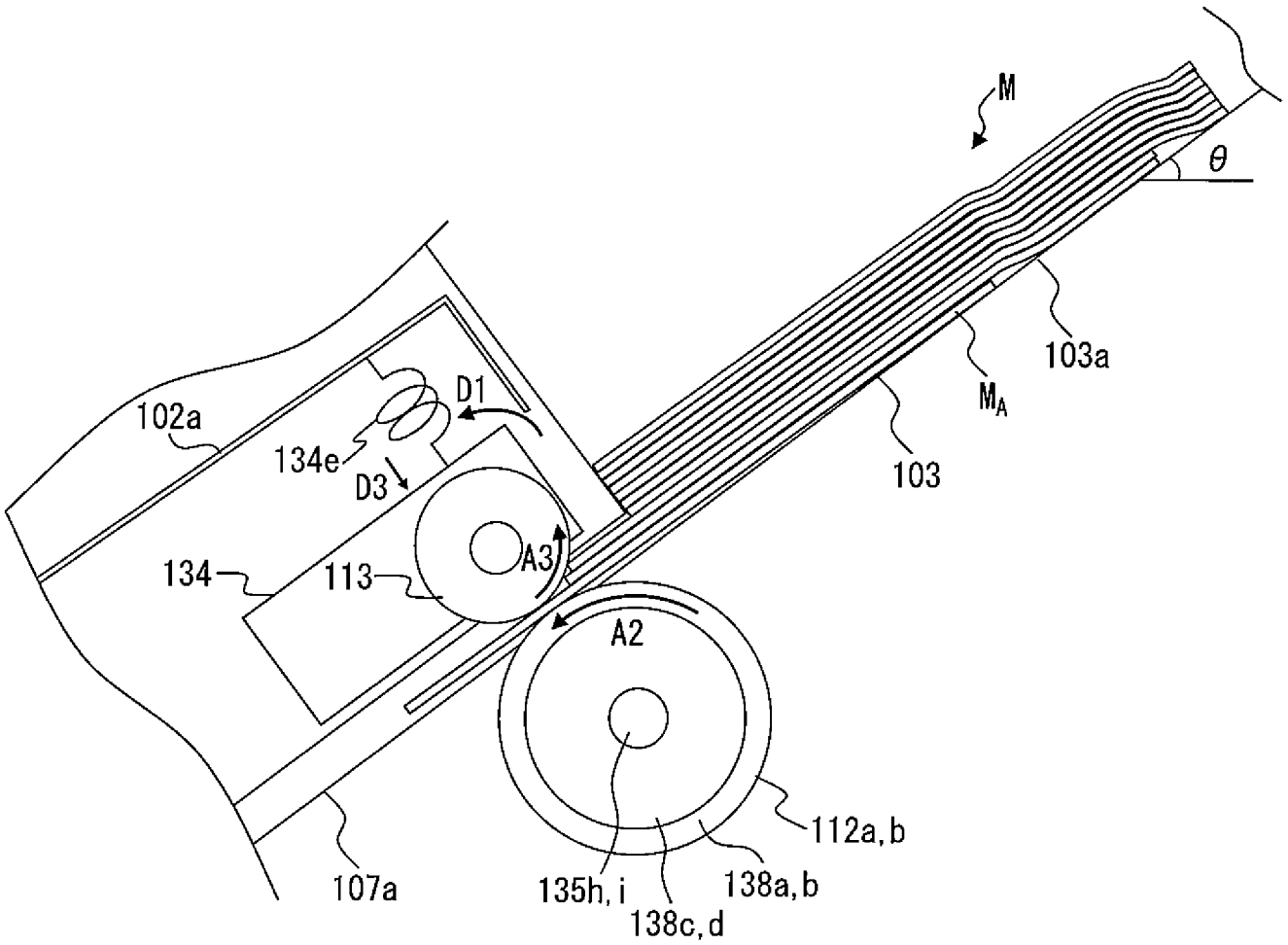
FIG. 8 is a schematic diagram for illustrating a movement of the brake rollers 113, etc.

FIG. 8 is a schematic diagram for illustrating movements of the feed rollers 112 and the brake rollers 113 when the first motor 131 generates the first driving force.

As illustrated in FIG. 8, one end of a spring 134*e* is mounted on a top surface of the support member 134 of the brake rollers 113, the other end of the spring 134*e* being supported by the internal housing 102*a*, and the support member 134 is urged by the spring 134*e* in a direction D3 toward the feed rollers 112 side.

As described above, the feed rollers 112 are provided to rotate in the medium feeding direction A2, and also the brake rollers 113 are provided to rotate in the direction A3 opposite to the medium feeding direction or stop, when the first motor 131 generates the first driving force. Further, a force in the direction D1 separating from the feed rollers 112 is applied to the brake rollers 113 by the brake roller unit 133. Consequently, the brake rollers 113 press the feed rollers 112 with a force acquired by subtracting a turning force by the brake roller unit 133 from an urging force by the spring 134*e*. Consequently, the brake rollers 113 can press the feed rollers 112 with a moderate force and satisfactorily separate only a medium $M_A$ to be fed out of a medium group M placed on the medium tray 103.

Figure 9:
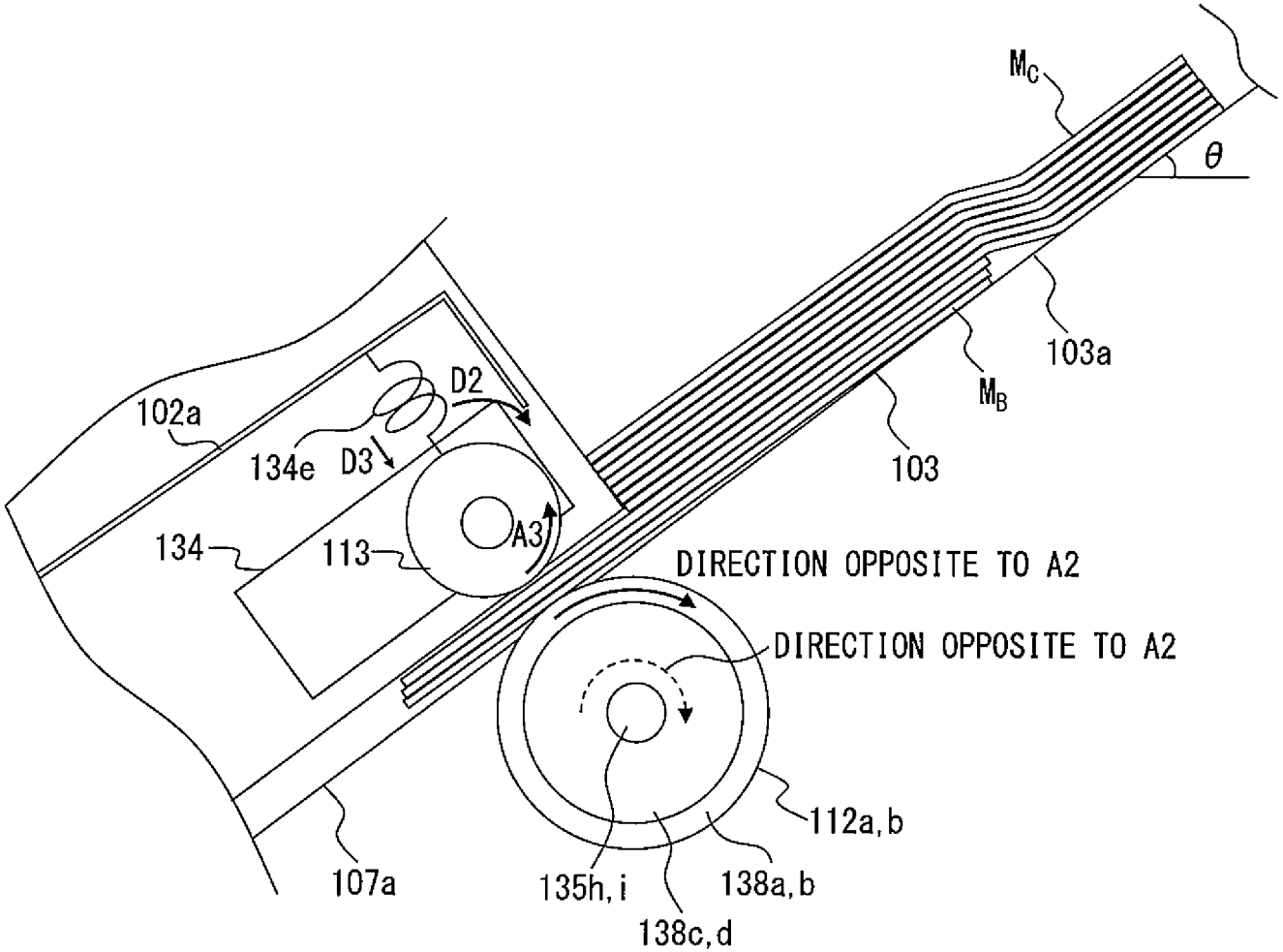
FIG. 9 is a schematic diagram for illustrating a movement of the brake rollers 113, etc.

FIG. 9 is a schematic diagram for illustrating movements of the feed rollers 112 and the brake rollers 113 when the first motor 131 generates the second driving force.

As described above, the brake rollers 113 are provided to rotate in the direction A3 opposite to the medium feeding direction when the first motor 131 generates the second driving force. At this time, the limit value of torque applied to the brake roller 113 is set in such a way that a turning force is transmitted even when a plurality of media are fed.

On the other hand, when the first motor 131 and the second motor generate the second driving force, the eighth shaft 135*h* and the ninth shaft 135*i* being the respective rotation axes of the feed rollers 112*a* and 112*b* rotate in the direction opposite to the medium feeding direction A2. However, the respective outer peripheral surfaces 138*a* and 138*b* of the feed rollers 112*a* and 112*b* do not rotate in the direction opposite to the arrow A2 according to the second driving force, due to the workings of the one-way clutches 138*c* and 138*d*. Accordingly, the respective outer peripheral surfaces 138*a* and 138*b* of the feed rollers 112*a* and *b* rotate in the direction opposite to the medium feeding direction A2 driven by the brake rollers 113*a* and 113*b*, respectively.

The eighth shaft 135*h* and the ninth shaft 135*i* being the respective rotation axes of the feed rollers 112*a* and 112*b* are provided in such a way as to rotate at a rotation speed faster than a rotation speed of the respective outer peripheral surfaces 138*a* and 138*b* of the feed rollers 112*a* and 112*b* driven to rotate by the brake rollers 113. Consequently, the respective outer peripheral surfaces 138*a* and 138*b* of the feed rollers 112*a* and 112*b* rotate according to rotation of the outer peripheral surfaces of the brake rollers 113 without being hampered by the one-way clutches 138*c* and 138*d*. Thus, the feed rollers 112 are provided to be driven to rotate in the direction opposite to the medium feeding direction A2 by the brake rollers 113. Further, the brake rollers 113 rotate in the direction A3 opposite to the medium feeding direction without receiving a load from the feed rollers 112.

Accordingly, even when a plurality of media $M_B$ are multi-fed between the brake rollers 113 and the feed rollers 112, the medium conveying apparatus 100 can reset all of the plurality of media $M_B$ to the medium tray 103 by generating the second driving force by the first motor 131. Particularly, the medium conveying apparatus 100 can restore a medium without adding a torque control device such as a hysteresis brake and can suppress increase in cost, size, and power consumption of the device.

Further, a force in the direction D2 toward the feed rollers 112 is applied to the brake rollers 113 by the brake roller unit 133. Consequently, the brake rollers 113 press the feed rollers 112 with a force acquired by adding a turning force by the brake roller unit 133 to an urging force by the spring 134*e*. In other words, a pressing force with which the brake rollers 113 press the feed rollers 112 when resetting a fed medium to the medium tray 103 is greater than a pressing force with which the brake rollers 113 press the feed rollers 112 when feeding a medium. Accordingly, when resetting a fed medium to the medium tray 103, the medium conveying apparatus 100 can increase a medium clamping force by the brake rollers 113 and the feed rollers 112, and increase a force for resetting a medium to the medium tray 103. Consequently, the medium conveying apparatus 100 can suppress a slip of a medium and satisfactorily reset a fed medium to the medium tray 103.

The medium tray 103 in the medium conveying apparatus 100 is provided in such a way that a placement surface 103*a* of a medium is tilted against an installation surface of the medium conveying apparatus 100 by a predetermined angle θ, and the medium conveying apparatus 100 sequentially feeds media from the lower side by use of self weights of media placed on the medium tray 103. When media multi-feed occurs in the so-called bottom-first type medium conveying apparatus 100, other media $M_B$ may be loaded on multi-fed media $M_A$ on the medium tray 103. Accordingly, when the multi-fed media $M_A$ are reset to the medium tray 103, a frictional load is generated between the multi-fed media $M_A$ and the media $M_B$ remaining on the medium tray 103. Even when another medium $M_C$ is loaded on the multi fed media $M_B$, the medium conveying apparatus 100 can satisfactorily reset the media $M_B$ by increasing a pressing force of the brake rollers 113 when resetting a medium to the medium tray 103. Further, by making a limit value of torque applied to the brake roller 113 when the multi-fed media $M_B$ are reset to the medium tray 103 greater than the limit value when feeding a medium, the medium conveying apparatus 100 can satisfactorily reset the media $M_B$.

Assuming that a medium conveying apparatus stops feed rollers and resets only other multi-fed media to a medium tray while keeping a medium in contact with the feed rollers at the position, a frictional load is also generated between the medium in contact with the feed roller and the other multi-fed media. On the other hand, the medium conveying apparatus 100 according to the present embodiment causes the feed rollers 112 to be driven by the brake rollers 113 and resets all multi-fed media $M_B$ to the medium tray 103. Consequently, a frictional load is not generated between a medium in contact with the feed rollers 112 and other multi-fed media, and instead, a frictional load is generated between the fed medium $M_B$ and the placement surface 103*a* of the medium tray 103. However, the medium tray 103 is formed by a resin member, and a frictional load generated between a medium such as paper and the placement surface 103*a* is sufficiently smaller than a frictional load generated between two media (approximately 2/7). Accordingly, compared with the case of resetting only other multi-fed media to the medium tray while keeping a medium in contact with the feed roller at the position, the medium conveying apparatus 100 can reset the medium to the medium tray 103 with a smaller force.

Further, when a plurality of media with different sizes are placed on the medium tray 103, a medium with a smaller size may be buried under a medium with a larger size, and the media may be conveyed without respective front edges of the media being aligned. Particularly, when a medium placed on the upper side precedes a medium placed on the lower side, the medium placed on the upper side may pass between the feed rollers 112 and the brake rollers 113 before the medium placed on the lower side, and media multi-feed may occur. The medium conveying apparatus 100 resets multi-fed media by driving the brake rollers 113 located on the upper side and therefore resets the medium placed on the upper side to the medium tray 103 side more firmly than the medium placed on the lower side. Consequently, the medium conveying apparatus 100 can reduce misalignment of front edges of the media reset to the medium tray 103 and reduce a possibility of occurrence of the media multi-feed at the time of refeed.

Further, a limit value is also set to torque applied to the brake rollers 113 in the medium conveying apparatus 100 when multi-fed media $M_B$ are reset to the medium tray 103. Accordingly, for example, when a weight of media remaining on the medium tray 103 is so heavy that multi-fed media cannot be satisfactorily reset to the medium tray 103, the medium conveying apparatus 100 does not forcibly restore the media. Consequently, the medium conveying apparatus 100 can prevent occurrence of damage to a medium.

The feed rollers 112*a* and 112*b* may not include the one-way clutches 138*c* and 138*d*, respectively, and the outer peripheral surfaces 138*a* and 138*b* may be provided to rotate according to rotation of the eighth shaft 135*h* and the ninth shaft 135*i*. Further, the feed rollers 112 may be provided to stop rather than rotate when the first motor 131 generates the second driving force.

Figure 10:
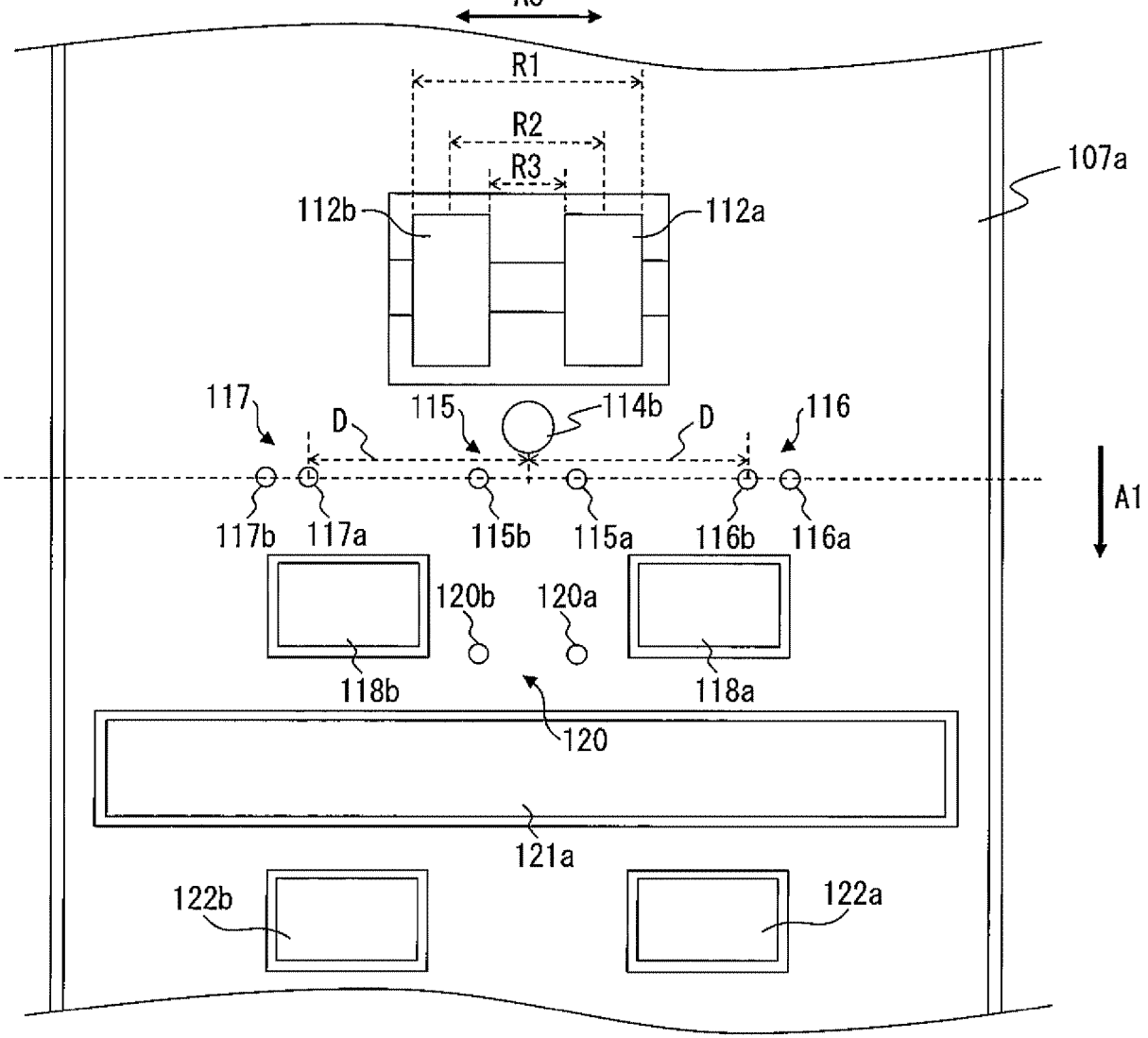
FIG. 10 is a schematic diagram for illustrating a first center sensor 115, etc.

FIG. 10 is a schematic diagram for illustrating the first center sensor 115, the first side sensor 116, the second side sensor 117, and the second center sensor 120. The first center sensor 115 is an example of a first sensor. The first side sensor 116 and the second side sensor 117 are example of a second sensor and a third sensor. FIG. 10 is a schematic diagram of the lower housing 101 viewed from above in a state in which the upper housing 102 is removed.

As illustrated in FIG. 10, the first center sensor 115 is located at an almost central part in the direction A8 perpendicular to the medium conveying direction A1, on the downstream side of the ultrasonic sensor 114 and on the upstream side of the first conveyance rollers 118 and the second conveyance rollers 119 in the medium conveying direction. Particularly, the first center sensor 115 is located in a region R1 inside outer edges of the plurality of feed rollers 112*a* and 112*b* in the direction A8 perpendicular to the medium conveying direction. It is more preferable that the first center sensor 115 be located in a region R2 inside center positions of the feed rollers 112*a* and 112*b* or a region R3 inside inner edges of the feed rollers 112*a* and 112*b*. The first center sensor 115 includes a first center light emitter 115*a* and a first center light receiver 115*b* provided on one side (the lower housing 101) of a medium conveyance path. Further, the first center sensor 115 includes a first center reflection member (unillustrated), such as a mirror, provided at a position (the upper housing 102) facing the first center light emitter 115*a* and the first center light receiver 115*b* with the medium conveyance path in between. The first center light emitter 115*a* emits light toward the medium conveyance path. On the other hand, the first center light receiver 115*b* receives light emitted by the first center light emitter 115*a* and reflected by the first center reflection member, and generates and outputs a first center signal being an electric signal based on intensity of the received light.

The first side sensor 116 and the second side sensor 117 are located at the same position as the first center sensor 115 or on the downstream side of the first center sensor 115 in the medium conveying direction A1. Further, the first side sensor 116 and the second side sensor 117 are spaced and located alongside with respect to the first center sensor 115 outside the first center sensor 115, that is, on a side of the first center sensor 115 in the direction A8 perpendicular to the medium conveying direction. In other words, the first side sensor 116 and the second side sensor 117 are located on both sides of the first center sensor 115 in the direction A8 perpendicular to the medium conveying direction. The first and second side sensors 116 and 117 include first and second side light emitters 116*a* and 117*a*, and first and second side light receivers 116*b* and 117*b* each of which is provided on one side (the lower housing 101) of the medium conveyance path. Further, the first and second side sensors 116 and 117 respectively include first and second side reflection members (unillustrated), such as mirrors, provided at a position (the upper housing 102) facing the respective side light emitters and the respective side light receivers with the medium conveyance path in between. The first and second side light emitters 116*a* and 117*a* emit light toward the medium conveyance path. On the other hand, the first and second side light receivers 116*b* and 117*b* receive light emitted by the first and second side light emitters 116*a* and 117*a* and reflected by the first and second side reflection members, respectively, and generate and output first and second side signals being electric signals based on intensity of the received light, respectively.

The second center sensor 120 is located on the downstream side of the first conveyance rollers 118 and the second conveyance rollers 119 and on the upstream side of the imaging devices 121 in the medium conveying direction A1, and on an almost central part in the direction A8 perpendicular to the medium conveying direction. The second center sensor 120 includes a second center light emitter 120*a* and a second center light receiver 120*b* provided on one side (the lower housing 101) of the medium conveyance path. Further, the second center sensor 120 includes a second center reflection member (unillustrated), such as a mirror, provided at a position (the upper housing 102) facing the second center light emitter 120*a* and the second center light receiver 120*b* with the medium conveyance path in between. The second center light emitter 120*a* emits light toward the medium conveyance path. On the other hand, the second center light receiver 120*b* receives light emitted by the second center light emitter 120*a* and reflected by the second center reflection member, and generates and outputs a second center signal being an electric signal based on intensity of the received light.

When a medium exists at each position of the first center sensor 115, the first side sensor 116, the second side sensor 117, and the second center sensor 120, light emitted by the light emitter in each sensor is shaded by the medium. Accordingly, a signal value of a signal generated by each sensor varies between a state in which a medium exists at a position of each sensor and a state in which a medium does not exist. Consequently, each of the first center sensor 115, the first side sensor 116, the second side sensor 117, and the second center sensor 120 detect whether or not a medium exists at the position and detects a fed medium. The light emitter and the light receiver in each sensor may be provided in positions facing one another with the conveyance path in between, and the reflection member may be omitted.

The first center sensor 115, the first side sensor 116, and the second side sensor 117 are used for detecting a skew being an oblique movement of a medium. As arrangement positions of the first side sensor 116 and the second side sensor 117 become closer to the center, a skew of a smaller sized medium can be detected. However, as the arrangement positions of the first side sensor 116 and the second side sensor 117 become closer to the center, a timing of the front edge of a tilted medium passing the first side sensor 116 or the second side sensor 117 becomes later, and a detection timing of a skew becomes later. Further, as the arrangement positions of the first side sensor 116 and the second side sensor 117 become closer to the center, a distance between the first side sensor 116 or the second side sensor 117, and the first center sensor 115 becomes shorter, and detection precision of a skew becomes lower. On the other hand, as the arrangement positions of the first side sensor 116 and the second side sensor 117 become closer to the outside, a detection timing of a skew becomes earlier, and also detection precision of a skew becomes higher; however, a skew of a smaller sized medium is not detected.

In general, a skew of a medium is likely to occur in a medium conveying apparatus supporting an A4 sheet or larger, when an A5 sheet is conveyed in a longitudinal direction or an A6 sheet is conveyed in a lateral direction. Accordingly, it is preferable that a distance D from the center position of the medium conveyance path to the first side sensor 116 and the second side sensor 117 in the direction A8 perpendicular to the medium conveying direction be less than or equal to ½ of a length of an A5 sheet in a widthwise direction (148 mm) or a length of an A6 sheet in a lengthwise direction. For example, it is preferable that the distance D from the center position of the medium conveyance path to the first side sensor 116 and the second side sensor 117 in the direction A8 perpendicular to the medium conveying direction be greater than or equal to 25 mm and less than or equal to 75 mm considering a margin.

Thus, the first center sensor 115, the first side sensor 116, and the second side sensor 117 are located on the downstream side of the feed rollers 112 and also on the upstream side of the first conveyance rollers 118 and the second conveyance rollers 119 in the medium conveying direction A1. Consequently, the medium conveying apparatus 100 can detect a skew of a medium before the medium reaches the positions of the first conveyance rollers 118 and the second conveyance rollers 119, and can correct the skew of the medium by use of the feed rollers 112.

Figure 11:
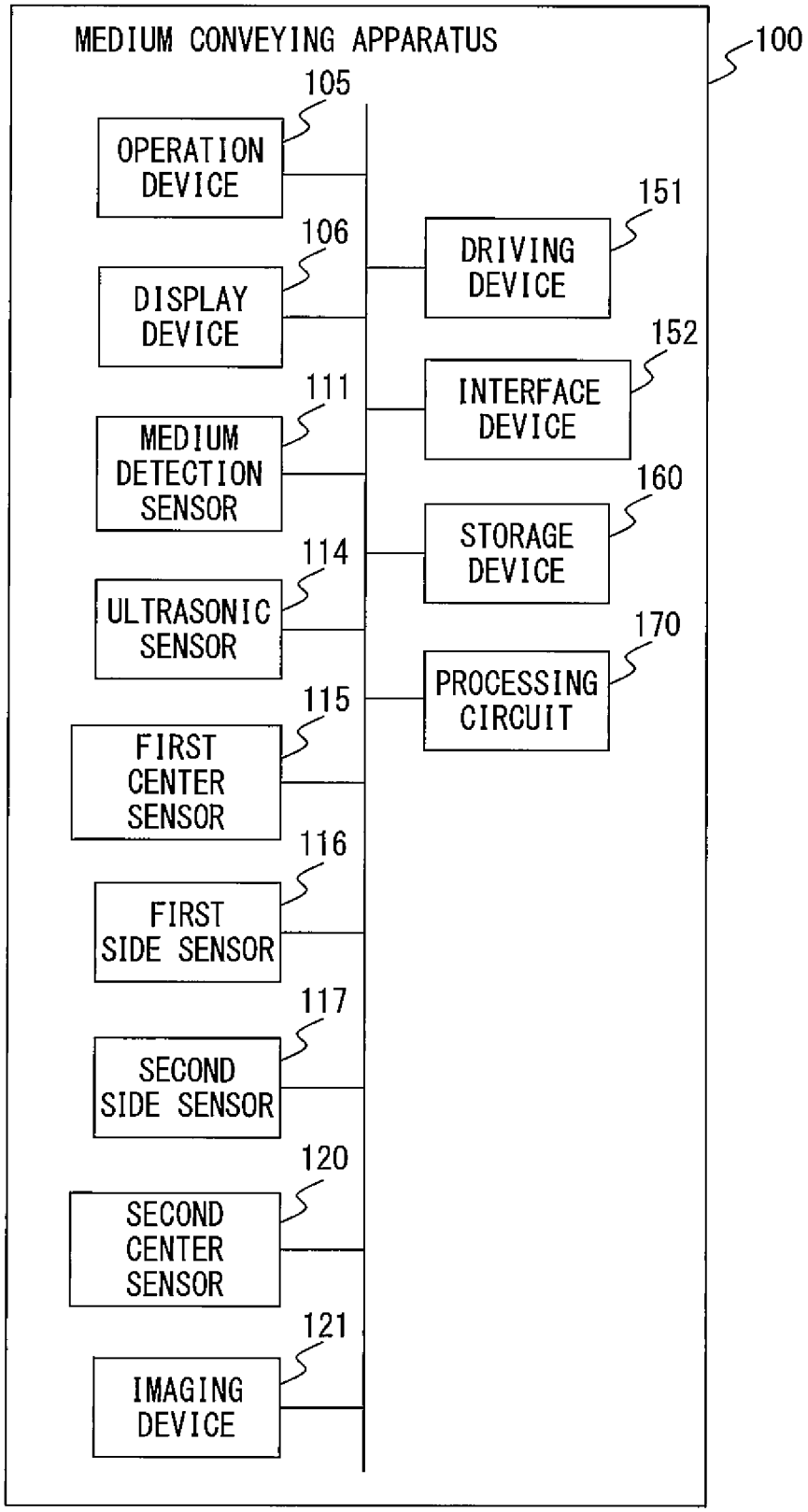
FIG. 11 is a block diagram illustrating a schematic configuration of the medium conveying apparatus 100.

FIG. 11 is a block diagram illustrating a schematic configuration of the medium conveying apparatus 100.

The medium conveying apparatus 100 further includes a driving device 151, an interface device 152, a storage device 160, and a processing circuit 170, etc., in addition to the configuration described above.

The driving device 151 is an example of a driving force generation module and generates the first driving force and the second driving force. The driving device 151 includes a plurality of motors including the first motor 131 and the second motor, and conveys a medium by rotating the feed rollers 112, the brake rollers 113, and the first to fourth conveyance rollers 118, 119, 122, and 123, by a control signal from the processing circuit 170.

For example, the interface device 152 includes an interface circuit conforming to a serial bus such as universal serial bus (USB), is electrically connected to an unillustrated information processing device (for example, a personal computer or a mobile information terminal), and transmits and receives an input image and various types of information. Further, a communication module including an antenna transmitting and receiving wireless signals, and a wireless communication interface device for transmitting and receiving signals through a wireless communication line in conformance with a predetermined communication protocol may be used in place of the interface device 152. For example, the predetermined communication protocol is a wireless local area network (LAN).

The storage device 160 includes a memory device such as a random access memory (RAM) or a read only memory (ROM), a fixed disk device such as a hard disk, or a portable storage device such as a flexible disk or an optical disk. Further, the storage device 160 stores a computer program, a database, a table, etc., used for various types of processing in the medium conveying apparatus 100. The computer program may be installed on the storage device 160 from a computer-readable, non-transitory medium such as a compact disk read only memory (CD-ROM), a digital versatile disk read only memory (DVD-ROM), etc., by using a well-known setup program, etc.

For example, the processing circuit 170 is a processor, such as a central processing unit (CPU). The processing circuit 170 operates in accordance with a program previously stored in the storage device 160. The processing circuit 170 may be a digital signal processor (DSP), a large scale integration (LSI), an application specific integrated circuit (ASIC), a field-programmable gate array (FPGA), etc.

The processing circuit 170 is connected to the operation device 105, the display device 106, the medium detection sensor 111, the ultrasonic sensor 114, the first center sensor 115, the first side sensor 116, the second side sensor 117, the second center sensor 120, the imaging devices 121, the driving device 151, the interface device 152, the storage device 160, the processing circuit 180, etc., and controls each of these units. The processing circuit 170 performs drive control of the driving device 151, imaging control of the imaging devices 121, etc., acquires an input image, and transmits the input image to the information processing device through the interface device 152. Further, the processing circuit 170 detects a skew of a fed medium based on a signal generated by the first center sensor 115, the first side sensor 116 or the second side sensor 117, and corrects the skew of the medium. Further, the processing circuit 170 detects the media multi-feed based on a signal generated by the ultrasonic sensor 114, and when the media multi-feed is detected, restores the media.

The processing circuit 170 executes predetermined image processing on an image imaged by the imaging device 121 and stores the image on which the image processing is executed into the storage device 160. A DSP, an LSI, an ASIC, an FPGA, etc., may be used in place of the processing circuit 180.

Figure 12:
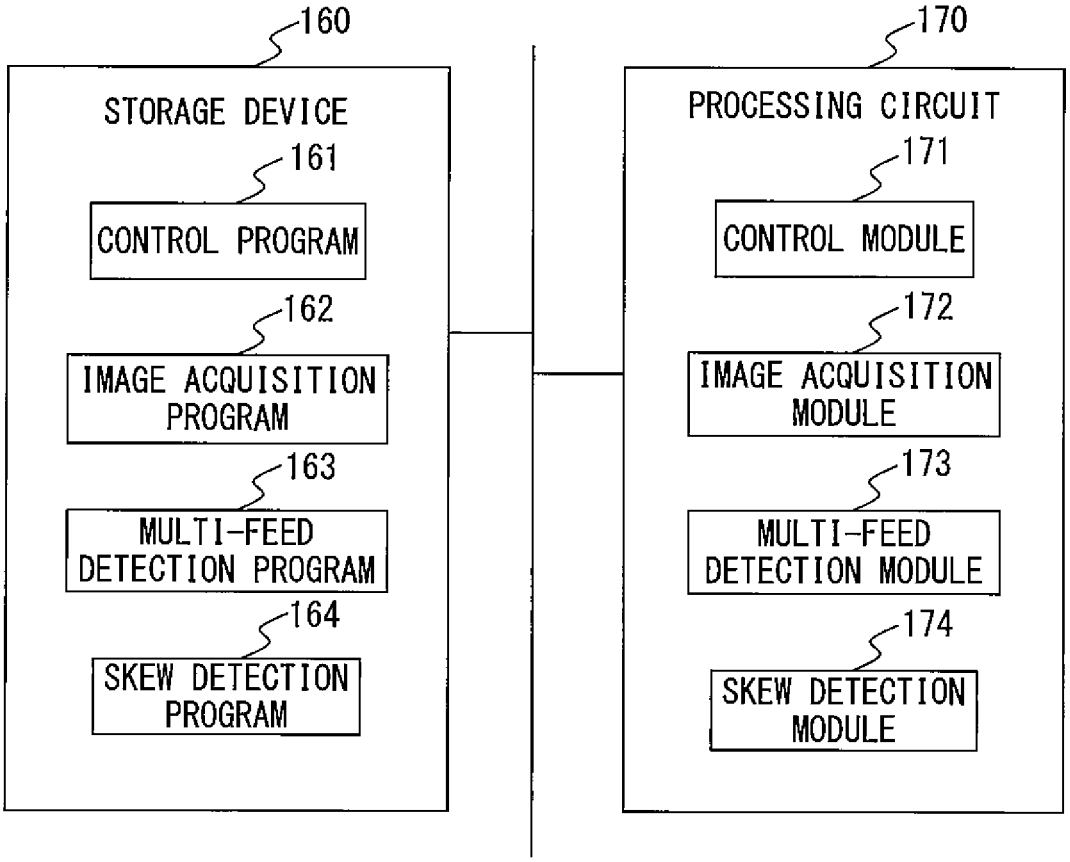
FIG. 12 is a diagram illustrating schematic configurations of a storage device 160 and a processing circuit 170.

FIG. 12 is a diagram illustrating schematic configurations of the storage device 160 and the processing circuit 170.

As illustrated in FIG. 12, the storage device 160 stores a control program 161, an image acquisition program 162, a multi-feed detection program 163, a skew detection program 164, etc. Each of these programs is a functional module implemented by software operating on a processor. The processing circuit 170 reads each program stored in the storage device 160 and operates in accordance with each read program. Consequently, the processing circuit 170 functions as a control module 171, an image acquisition module 172, a multi-feed detection module 173, and a skew detection module 174.

Figure 13:
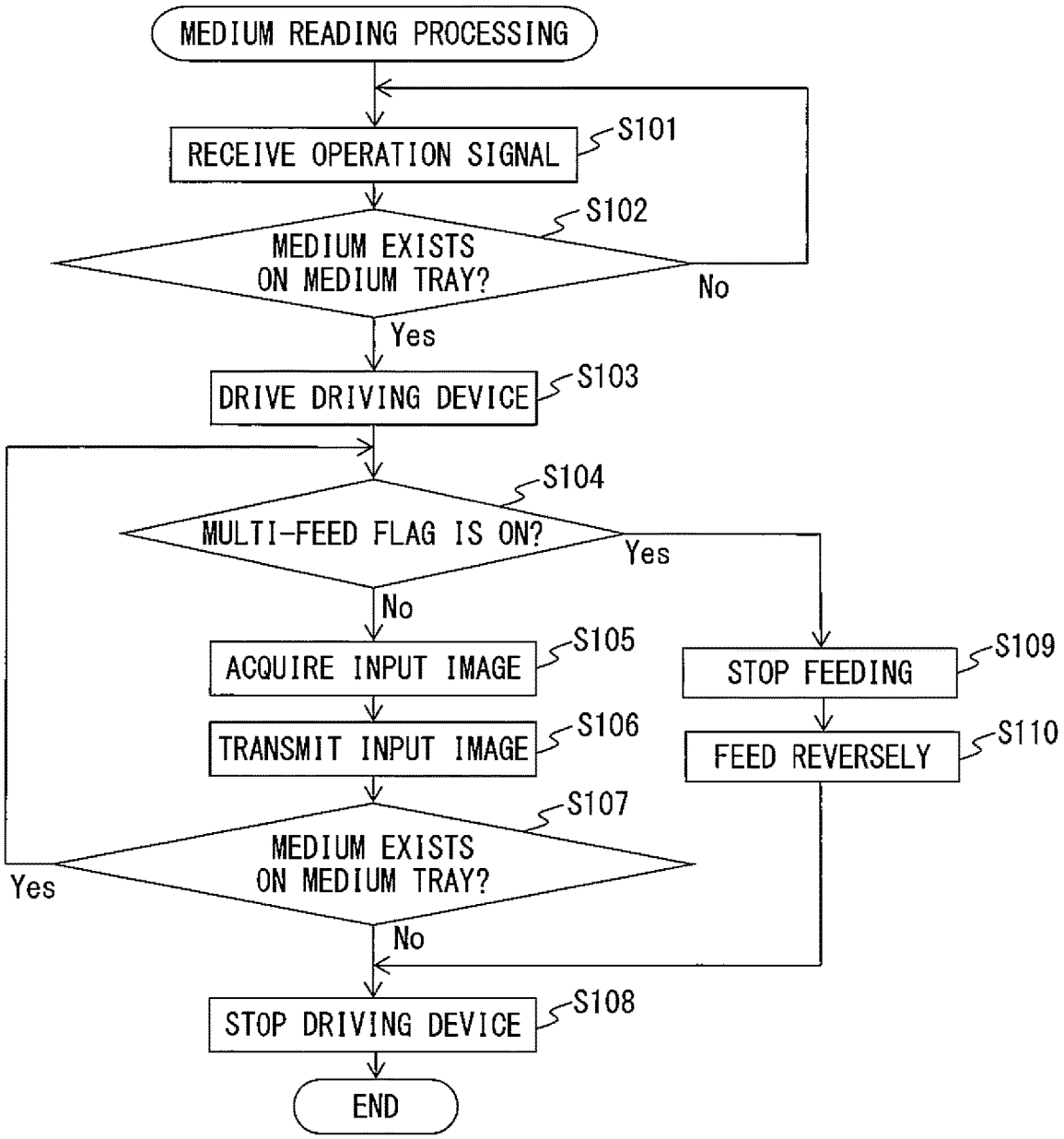
FIG. 13 is a flowchart illustrating an operation example of medium reading processing.

FIG. 13 is a flowchart illustrating an operation example of medium reading processing in the medium conveying apparatus 100.

Referring to the flowchart illustrated in FIG. 13, an operation example of the medium reading processing in the medium conveying apparatus 100 will be described below. The operation flow described below is executed mainly by the processing circuit 170 in cooperation with each element in the medium conveying apparatus 100, in accordance with a program previously stored in the storage device 160. The operation flow illustrated in FIG. 13 is periodically executed.

First, the control module 171 stands by until an instruction to read a medium is input by a user by use of the operation device 105, and an operation signal instructing to read the medium is received from the operation device 105 (step S101).

Next, the control module 171 acquires a medium detection signal from the medium detection sensor 111 and determines whether or not a medium is placed on the medium tray 103, based on the acquired medium detection signal (step S102).

When a medium is not placed on the medium tray 103, the control module 171 returns the processing to step S101 and stands by until newly receiving an operation signal from the operation device 105.

On the other hand, when a medium is placed on the medium tray 103, the control module 171 drives the driving device 151, rotates the feed rollers 112, the brake rollers 113, and the first to fourth conveyance rollers 118, 119, 122, and 123, and feeds and conveys the medium (step S103). The control module 171 performs control in such a way that the first motor 131 and the second motor generate the first driving force, the feed rollers 112 rotate in the medium feeding direction A2, and the brake rollers 113 rotate in the direction A3 opposite to the medium feeding direction. In other words, when feeding a medium, the control module 171 transmits the first driving force to the brake rollers 113 by the first transmission mechanism.

Next, the control module 171 determines whether or not a multi-feed flag is ON (step S104). The multi-feed flag is set to OFF at a start of reading for each medium and is set to ON when the multi-feed detection module 173 determines occurrence of the media multi-feed in multi-feed detection processing to be described later.

When the multi-feed flag is OFF, the image acquisition module 172 causes the imaging device 121 to image the conveyed medium and acquires an input image (step S105).

The image acquisition module 172 acquires a second center signal from the second center sensor 120 and determines whether or not a medium exists at the position of the second center sensor 120 based on the acquired second center signal. When a signal value of the second center signal changes from a value indicating nonexistence of a medium to a value indicating existence of a medium, the image acquisition module 172 determines that the front edge of the medium passes the position of the second center sensor 120 and causes the imaging device 121 to start imaging. On the other hand, when a signal value of the second center signal changes from the value indicating existence of a medium to the value indicating nonexistence of a medium, the image acquisition module 172 determines that the rear edge of the medium passes the position of the second center sensor 120. The image acquisition module 162 causes the imaging device 121 to end the imaging when a predetermined period elapses after determining that the rear edge of the medium passes the position of the second center sensor 120.

Next, the image acquisition module 172 transmits the input image to the information processing device through the interface device 152 (step S106). When not being connected to the information processing device, the image acquisition module 162 stores the input image in the storage device 160.

Next, the control module 171 determines whether or not a medium remains on the medium tray 103 based on a medium detection signal acquired from the medium detection sensor 111 (step S107). When a medium remains on the medium tray 103, the control module 171 returns the processing to step S104 and repeats the processing in steps S104 to S107.

On the other hand, when a medium does not remain on the medium tray 103, the control module 171 stops the driving device 141 (step S108) and ends the series of steps.

On the other hand, when the multi-feed flag is ON in step S104, the control module 171 stops feeding media by stopping the driving device 151 as abnormal processing and also sets the multi-feed flag to OFF (step S109). The control module 171 may notify a user of occurrence of abnormality by an unillustrated speaker, LED, etc.

Next, by driving the driving device 151, the control module 171 causes the feed rollers 112 and the brake rollers 113 to rotate, and convey the fed media toward the medium tray 103 (step S110). The control module 171 performs control in such a way that the first motor 131 and the second motor generate the second driving force, the feed rollers 112 rotate in the direction opposite to the medium feeding direction A2, and the brake rollers 113 rotate in the direction A3 opposite to the medium feeding direction. Consequently, the control module 171 controls the feed rollers 112 and the brake rollers 113 in such a way that the fed media is reset to the medium tray 103.

Specifically, when the media multi-feed is detected, the control module 171 performs control in such a way that the second driving force is transmitted to the brake rollers 113 by the second transmission mechanism, and also the feed rollers 112 are driven to rotate in the direction opposite to the medium feeding direction A2 by the brake rollers 113. As described above, the control module 171 performs control in such a way that the respective rotation axes (the eighth shaft 135*h* and the ninth shaft 135*i*) of the feed rollers 112 rotate at a rotation speed faster than a rotation speed of the respective outer peripheral surfaces 138*a* and 138*b* of the feed rollers 112 driven to rotate by the brake rollers 113.

Further, the control module 171 changes a pressing force with which the brake rollers 113 press the feed rollers 112, by switching between the first transmission mechanism and the second transmission mechanism as a transmission mechanism for transmitting a driving force from the first motor 131 to the brake rollers 113. As described above, a pressing force of the brake rollers 113 when resetting a fed medium to the medium tray 103 by use of the second transmission mechanism is greater than a pressing force of the brake rollers 113 when feeding a medium by use of the first transmission mechanism. In other words, the control module 171 controls the brake roller unit 133 in such a way that a pressing force of the brake rollers 113 when resetting a fed medium to the medium tray 103 is greater than a pressing force of the brake rollers 113 when feeding a medium.

Next, by stopping the driving device 151 after causing the feed rollers 112 and the brake rollers 113 to rotate for a certain time (for example, 3 seconds), the control module 171 resets the media to the medium tray 103 (step S108) and ends the series of steps. The control module 171 may rotate the feed rollers 112 and the brake rollers 113 until the multi-feed detection module 173 determines that multi-feed is not occurring (is cleared) in the multi-feed detection processing and then stop the driving device 151. Further, the control module 171 may return the processing to step S103 after resetting the media to the medium tray 103 and automatically refeed the media. Consequently, a user does not need to refeed the media, and the control module 171 can improve user convenience.

Figure 14:
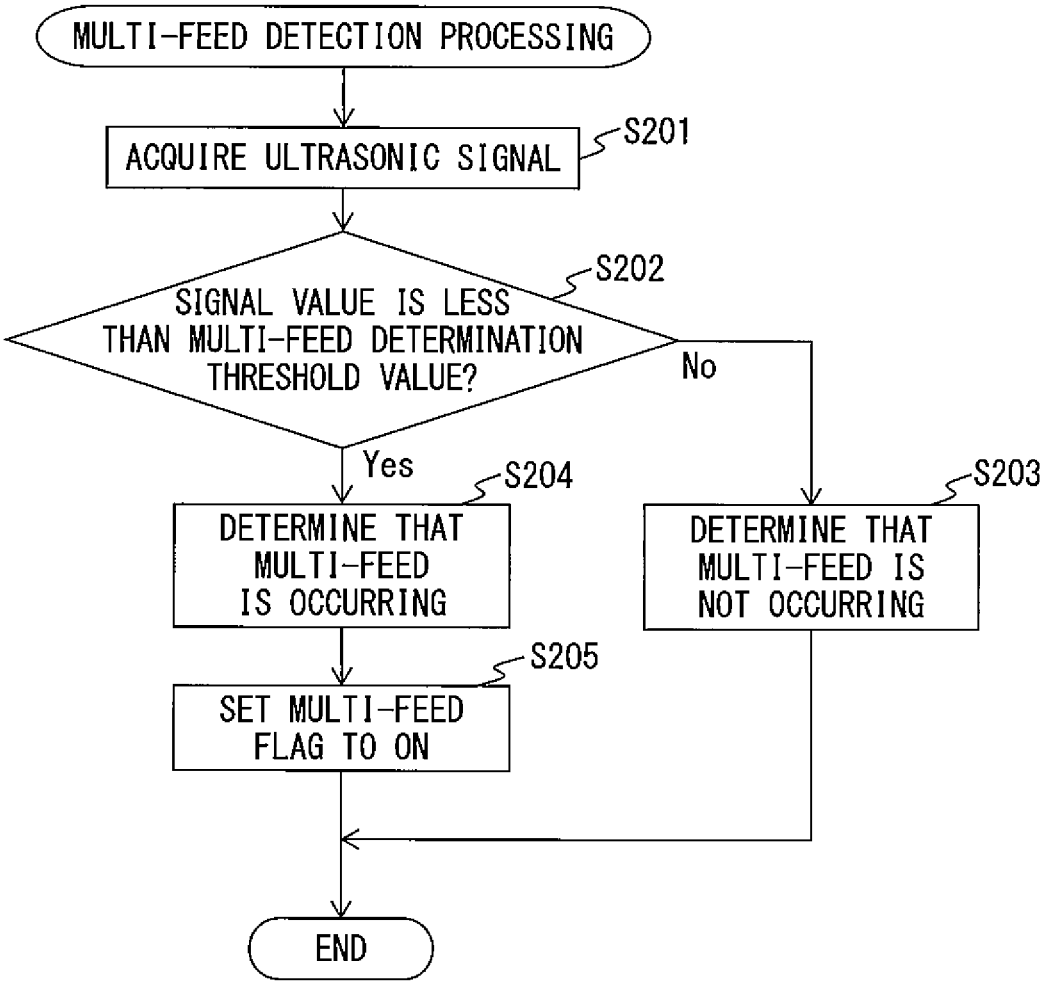
FIG. 14 is a flowchart illustrating an operation example of multi-feed detection processing.

FIG. 14 is a flowchart illustrating an operation example of the multi-feed detection processing.

Referring to the flowchart illustrated in FIG. 14, an operation example of the multi-feed detection processing in the medium conveying apparatus 100 will be described below. The operation flow described below is executed mainly by the processing circuit 170 in cooperation with each element in the medium conveying apparatus 100, in accordance with a program previously stored in the storage device 160. The flowchart illustrated in FIG. 14 is periodically executed during medium conveyance. The flowchart illustrated in FIG. 14 may be executed only in a period from a moment when the front edge of a medium passes the first center sensor 115 to a moment when the front edge passes the second center sensor 120.

First, the multi-feed detection module 173 acquires an ultrasonic signal from the ultrasonic sensor 114 (step S201).

Next, the multi-feed detection module 173 determines whether or not a signal value of the acquired ultrasonic signal is less than a multi-feed determination threshold value (step S202).

Figure 15:
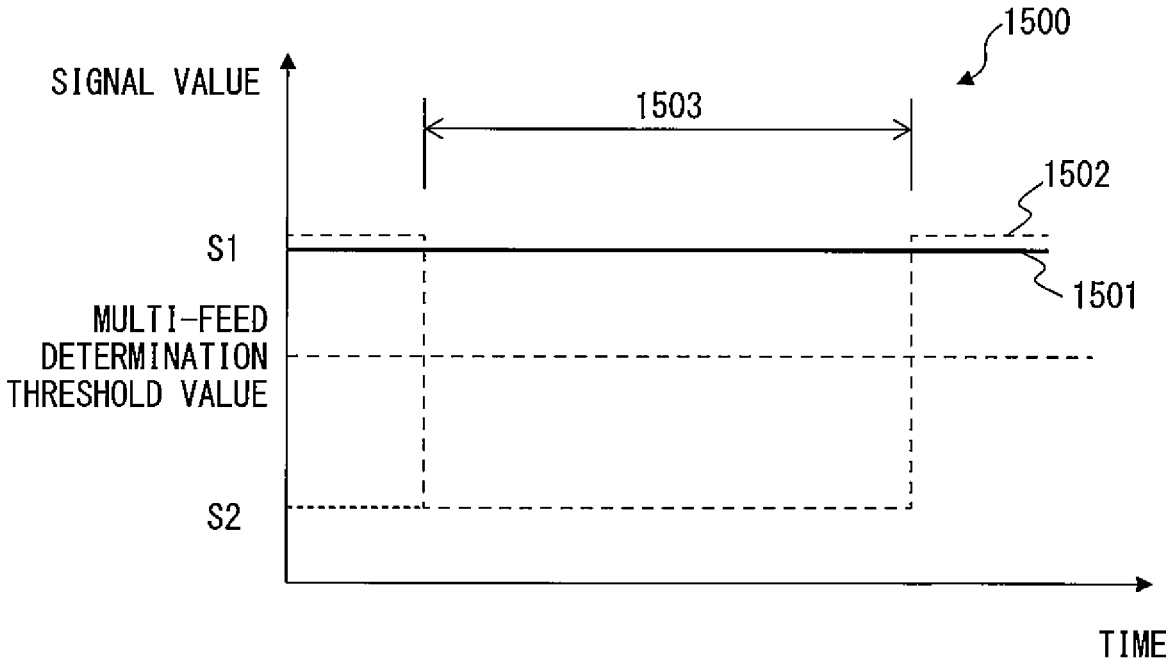
FIG. 15 is a schematic diagram for illustrating a characteristic of an ultrasonic signal.

FIG. 15 is a schematic diagram for illustrating a characteristic of an ultrasonic signal.

In a graph 1500 in FIG. 15, a solid line 1501 represents a characteristic of an ultrasonic signal when one sheet of paper is conveyed as a medium, and a dotted line 1502 represents a characteristic of an ultrasonic signal when multi-feed of paper is occurring. The horizontal axis of the graph 1500 indicates time, and the vertical axis indicates a signal value of an ultrasonic signal. Due to occurrence of multi-feed, a signal value of the ultrasonic signal in the dotted line 1502 declines in a section 1503. The multi-feed determination threshold value is set to a value between a signal value S1 of an ultrasonic signal when one sheet of paper is conveyed and a signal value S2 of an ultrasonic signal when multi-feed of paper is occurring. By determining whether or not a signal value of an ultrasonic signal is less than the multi-feed determination threshold value, the multi-feed detection module 173 can determine whether or not media multi-feed is occurring.

When a signal value of the ultrasonic signal is greater than or equal to the multi-feed determination threshold value, the multi-feed detection module 173 determines that multi-feed is not occurring (step S203) and ends the series of steps.

On the other hand, when a signal value of the ultrasonic signal is less than the multi-feed determination threshold value, the multi-feed detection module 173 determines that media multi-feed is occurring (step S204). Next, the multi-feed detection module 173 sets the multi-feed flag to ON (step S205) and ends the series of steps. Thus, the multi-feed detection module 173 detects the media multi-feed based on an ultrasonic signal generated by the ultrasonic sensor 114.

Figure 16:
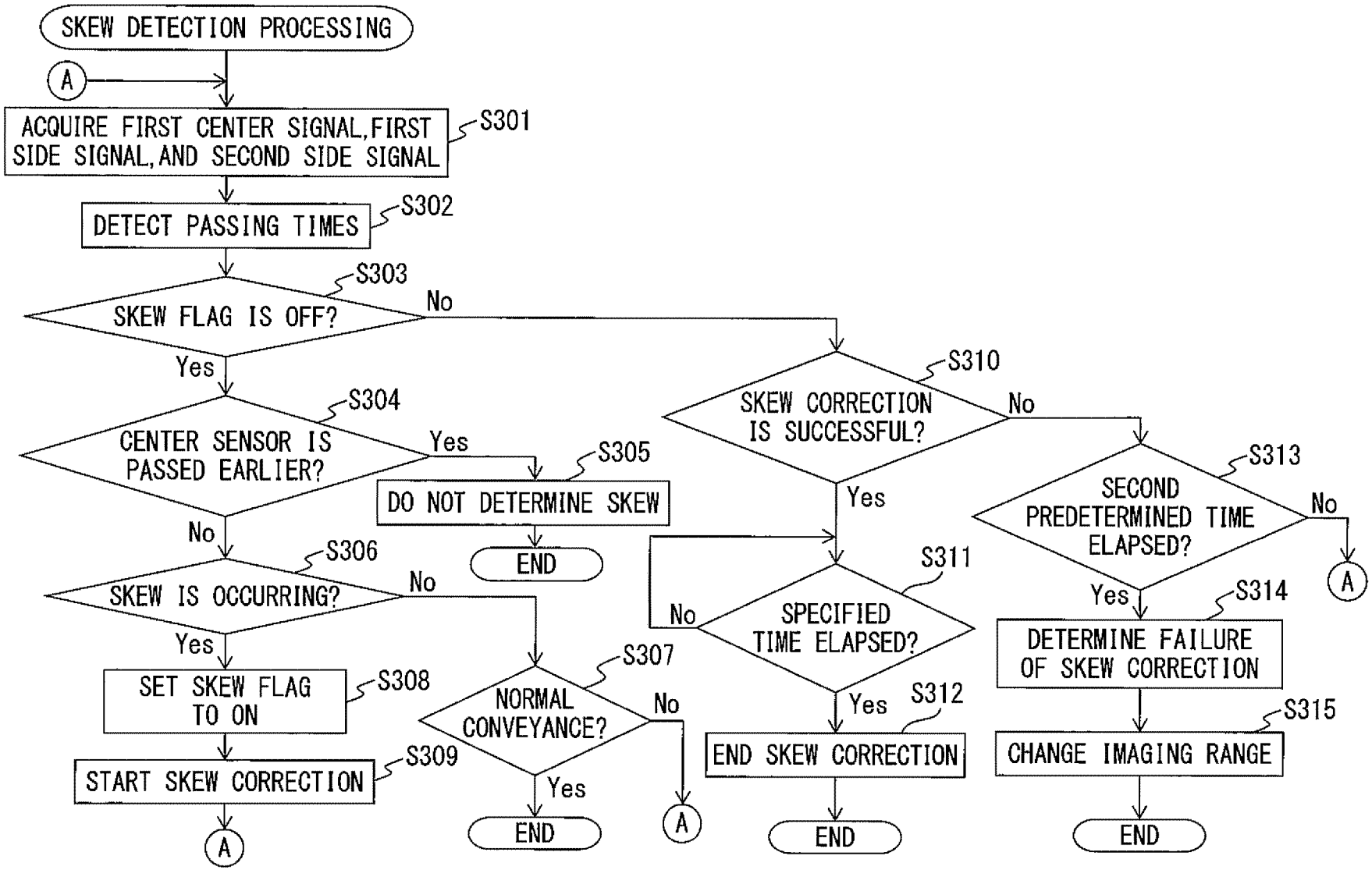
FIG. 16 is a flowchart illustrating an operation example of skew detection processing.

FIG. 16 is a flowchart illustrating an operation example of skew detection processing.

Referring to the flowchart illustrated in FIG. 16, an operation example of the skew detection processing in the medium conveying apparatus 100 will be described below. The operation flow described below is executed mainly by the processing circuit 170 in cooperation with each element in the medium conveying apparatus 100, in accordance with a program previously stored in the storage device 160. The flowchart illustrated in FIG. 16 is periodically executed.

First, the skew detection module 174 acquires a first center signal, a first side signal, and a second side signal from the first center sensor 115, the first side sensor 116, and the second side sensor 117, respectively (step S301).

Next, the skew detection module 174 detects passage times when the front edge of a medium passes the first center sensor 115, the first side sensor 116, and the second side sensor 117, respectively, based on the first center signal, the first side signal, and the second side signal (step S302).

In each of the first center signals acquired up to that point in time, the skew detection module 174 detects a time when a signal value changes from a value indicating a state in which a medium does not exist to a value indicating a state in which a medium exists, as a passage time of the first center sensor 115. Similarly, in each of the first side signals acquired up to that point in time, the skew detection module 174 detects a time when a signal value changes from a value indicating a state in which a medium does not exist to a value indicating a state in which a medium exists, as a passage time of the first side sensor 116. Similarly, in each of the second side signals acquired up to that point in time, the skew detection module 174 detects a time when a signal value changes from a value indicating a state in which a medium does not exist to a value indicating a state in which a medium exists, as a passage time of the second side sensor 117.

Next, the skew detection module 174 determines whether or not a skew flag is OFF (step S303). The skew flag is set to OFF at a start of reading for each medium and is set to ON when a skew is determined to occur in the skew detection processing.

When the skew flag is OFF, the skew detection module 174 determines whether or not the medium passes a position of the first center sensor 115 earlier than positions of the first side sensor 116 and the second side sensor 117 (step S304). The skew detection module 174 determines whether or not the medium passes the position of the first center sensor 115 earlier depending on whether or not the passage time of the first center sensor 115 is earlier than the earlier of the passage times of the respective side sensors.

When the medium passes the position of the first center sensor 115 earlier, the skew detection module 174 determines not to determine whether or not a skew of the medium is occurring (step S305) and ends the series of steps. Specifically, when the first center sensor 115 detects the medium before either of the first side sensor 116 and the second side sensor 117 detects the medium, the skew detection module 174 does not determine whether or not a skew of the medium is occurring. In this case, the control module 171 does not correct a skew of the medium and does not make circumferential speeds of the plurality of feed rollers 112 mutually different.

Figure 17A:
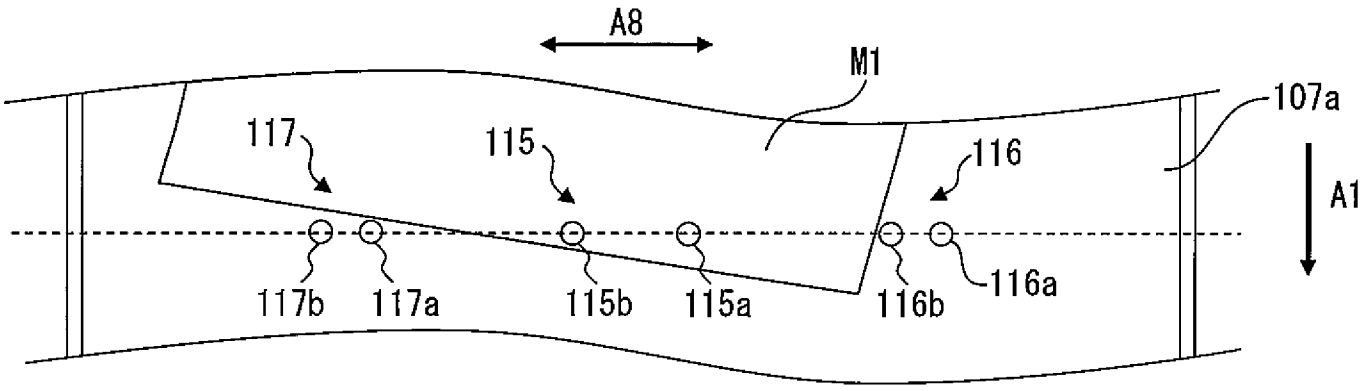
FIG. 17A is a schematic diagram for illustrating a fed medium.
Figure 17B:
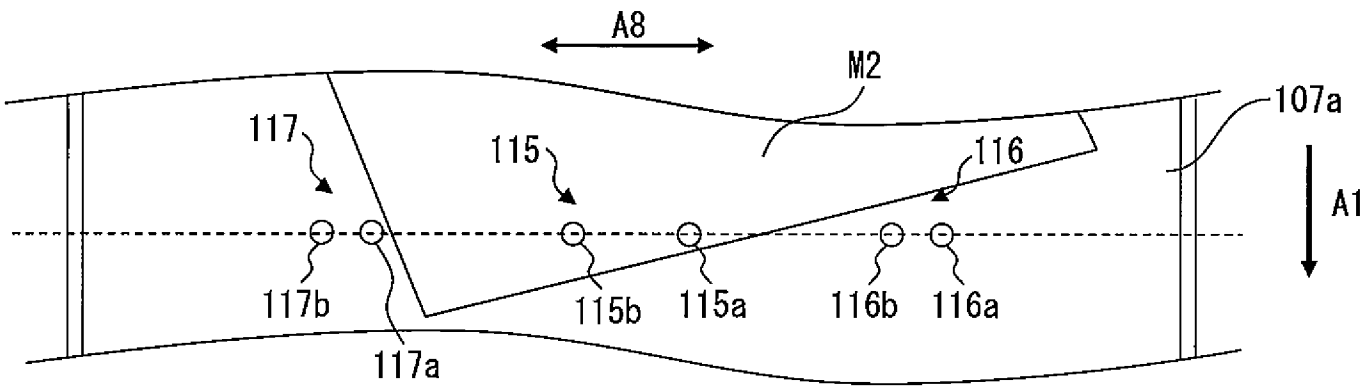
FIG. 17B is a schematic diagram for illustrating a fed medium.

FIG. 17A and FIG. 17B are schematic diagrams for illustrating a medium detected by the first center sensor 115 earlier. Each of FIG. 17A and FIG. 17B is a schematic diagram of the lower housing 101 viewed from above in a state in which the upper housing 102 is removed, similarly to FIG. 10.

FIG. 17A illustrates an example of a medium M1 being fed while being tilted toward the second side sensor 117 side, and FIG. 17B illustrates an example of a medium M2 being fed while being tilted toward the first side sensor 116 side. Both of the medium M1 illustrated in FIG. 17A and the medium M2 illustrated in FIG. 17B are detected by the first center sensor 115 earlier than by the first side sensor 116 and the second side sensor 117. In other words, when the first center sensor 115 detects a medium first, the skew detection module 174 cannot specify a direction toward which the medium is tilted. By not determining whether or not a skew of a medium is occurring when the first center sensor 115 detects the medium first, the skew detection module 174 can prevent the control module 171 from erroneously correcting a skew of the medium.

On the other hand, when a medium passes the position of the first side sensor 116 or the second side sensor 117 earlier, the skew detection module 174 determines whether or not a skew of the medium is occurring based on each passage time detected in step S302 (step S306). The skew detection module 174 determines occurrence of a skew when the front edge of the medium does not pass the first center sensor 115 before a predetermined time elapses from a time being the earlier of the passage time of the first side sensor 116 and the passage time of the second side sensor 117. In other words, the skew detection module 174 determines that a skew is occurring when the first center sensor 115 does not detect the medium within the predetermined time after either of the first side sensor 116 and the second side sensor 117 detects the medium. The predetermined time is set to a value between a difference between the passage time of the first or second side sensor 116 or 117 and the passage time of the first center sensor 115 when a medium is tilted and collides with a side wall of the conveyance path, and a difference between the respective passage times when a medium does not collide with the side wall of the conveyance path, based on a previously performed experiment. For example, the predetermined time is set to 1 second. The predetermined time may be set to 0. In that case, the skew detection module 174 determines occurrence of a skew when a medium is conveyed with a slightest tilt, and the control module 161 corrects the skew of the medium. Thus, the skew detection module 174 determines that a skew is occurring when any of the first side sensor 116 or the second side sensor 117 detects the medium and the first center sensor 115 does not detect the medium within a predetermined time.

Thus, the skew detection module 174 detects a skew of a fed medium based on the first center signal acquired from the first center sensor 115, the first side signal acquired from the first side sensor 116, and the second side signal acquired from the second side sensor 117.

When determining that a skew of a medium is not occurring, the skew detection module 174 determines whether or not the medium is normally conveyed (step S307). The skew detection module 174 determines that the medium is normally conveyed when the front edge of the medium passes the first center sensor 115 before a predetermined time elapses from a time being the earlier of the passage time of the first side sensor 116 and the passage time of the second side sensor 117. In this case, the skew detection module 164 ends the skew detection processing, and ends the series of steps. On the other hand, the skew detection module 174 returns the processing to step S301 when the predetermined time does not elapse from the time being the earlier of the passage time of the first side sensor 116 and the passage time of the second side sensor 117, and also the front edge of the medium does not pass the first center sensor 115. In other words, in this case, the skew detection module 174 does not yet determine whether a skew is occurring or the medium is normally conveyed.

On the other hand, when determining occurrence of a skew of the medium, that is, when detecting a skew of the medium, the skew detection module 174 sets the skew flag to ON (step S308).

Next, the control module 171 starts skew correction of the medium (step S309) and moves the processing to step S301. The control module 171 corrects the skew of the medium by making circumferential speeds of a plurality of feed rollers 112*a* and 112*b* mutually different, that is, by changing the speed of at least one of a plurality of feed rollers 112*a* and *b*. The control module 171 changes a circumferential speed of each feed roller 112 in such a way that a circumferential speed of a feed roller 112 located on the side where progression of the medium is delayed in the direction A8 perpendicular to the medium conveying direction is faster (higher) than a circumferential speed of a feed roller 112 located on the preceding side. The control module 171 accelerates (increases) the circumferential speed of the feed roller 112 located on the side where progression of the medium is delayed and/or decelerates (decreases) the circumferential speed of the feed roller 112 located on the preceding side. For example, the control module 171 sets each circumferential speed in such a way that the circumferential speed of the feed roller 112 located on the side where progression of the medium is delayed is faster than the circumferential speed of the feed roller 112 located on the preceding side by a factor greater than or equal to three and less than or equal to ten.

Figure 18:
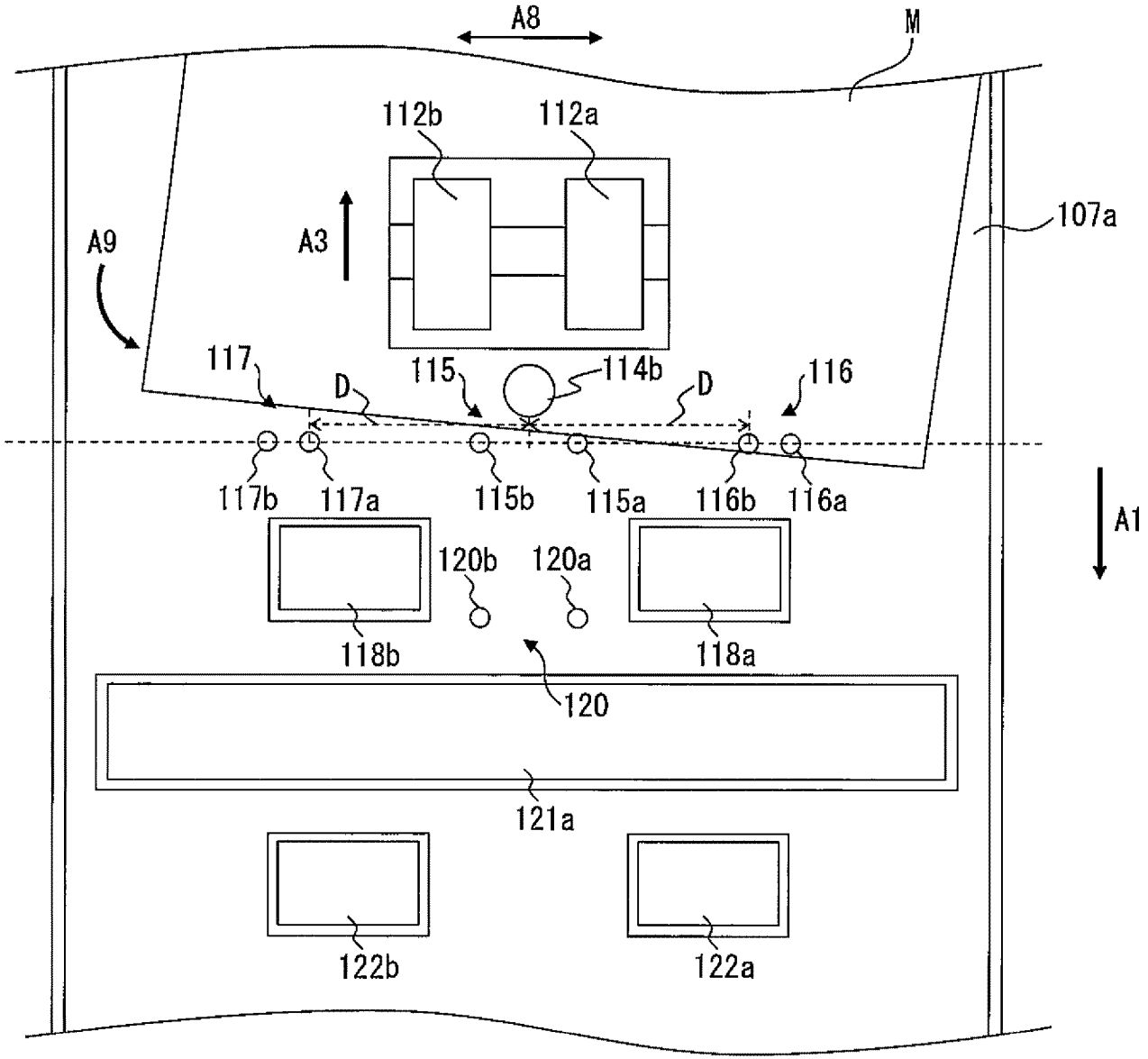
FIG. 18 is a schematic diagram for illustrating a relation between a tilt of a medium and a passage time.

FIG. 18 is a schematic diagram for illustrating a relation between a tilt of a medium and a passage time of each sensor. FIG. 16 is a schematic diagram of the lower housing 101 viewed from above in a state in which the upper housing 102 is removed, similarly to FIG. 10.

As illustrated in FIG. 18, when a medium M is fed while being tilted toward the second side sensor 117 side, the front edge of the medium M passes the first side sensor 116 and then passes the first center sensor 115. In that case, as the tilt of the medium M becomes greater, a period between a time when the first side sensor 116 is passed and a time when the first center sensor 115 is passed increases.

Accordingly, when the front edge of the medium does not pass the first center sensor 115 within a predetermined time from the passage time of the first side sensor 116, the control module 171 determines that the medium is fed while being tilted toward the second side sensor 117 side. In that case, the control module 171 changes a circumferential speed of each feed roller 112 in such a way that the circumferential speed of the feed roller 112*b* located on the second side sensor 117 side is faster (higher) than the circumferential speed of the feed roller 112 located on the first side sensor 116 side. Consequently, the medium rotates toward a direction A9 of the first side sensor 116, and the skew of the medium is corrected.

On the other hand, when the front edge of the medium does not pass the first center sensor 115 within the predetermined time from the passage time of the second side sensor 117, the control module 171 determines that the medium is fed while being tilted toward the first side sensor 116 side. In that case, the control module 171 changes the circumferential speed of each feed roller 112 in such a way that the circumferential speed of the feed roller 112*a* located on the first side sensor 116 side is faster (higher) than the circumferential speed of the feed roller 112*b* located on the second side sensor 117 side. Consequently, the medium rotates toward a direction of the second side sensor 117, and the skew of the medium is corrected.

As described above, each of the feed rollers 112*a* and 112*b* is provided in such a way as to independently rotate, and feed a medium, by the separate first motor 131 and second motor. On the other hand, the brake rollers 113*a* and 113*b* are separately provided with the second torque limiters 137*a* and 137*b*, respectively, and therefore the brake rollers 113*a* and 113*b* are independently driven to rotate by the feed rollers 112*a* and 112*b*, respectively. Assuming that each of the brake rollers 113*a* and 113*b* is not driven to rotate independently, even when respective circumferential speeds of the feed rollers 112 are different, a conveyance load (a separating force of the medium) applied to the medium in the direction A3 opposite to the medium feeding direction by each of the brake rollers 113*a* and 113*b* are at the same level. Accordingly, a force for rotating the medium toward a direction of a side sensor on the side of a feed roller 112 with a lower circumferential speed (the direction A9 in the example in FIG. 18) decreases, and the skew of the medium becomes less likely to be corrected.

On the other hand, when each of the brake rollers 113*a* and 113*b* is driven to rotate independently, a conveyance load applied to the medium in the direction A3 opposite to the medium feeding direction by each of the brake rollers 113*a* and 113*b* varies between circumferential speeds of the feed rollers 112*a* and 112*b* facing the brake rollers 113*a* and 113*b*, respectively. Specifically, a conveyance load applied to the medium in the direction A3 opposite to the medium feeding direction by a brake roller 113 facing a feed roller 112 with a lower circumferential speed is less than a conveyance load applied to the medium in the direction A3 opposite to the medium feeding direction by the other brake roller 113. Accordingly, a force for rotating the medium toward a direction of a side sensor on the side of the feed roller 112 with the lower circumferential speed (the direction A9 in the example in FIG. 18) increases, and the skew of the medium becomes more likely to be corrected.

The control module 171 may set each circumferential speed of the feed rollers 112 in such a way that as a period from the passage time of the first side sensor 116 or the passage time of the second side sensor 117 to the passage time of the first center sensor 115 becomes greater, a difference between the circumferential speeds becomes greater. Consequently, the control module 171 can correct a skew of a medium in a shorter period. Further, the control module 171 may set a circumferential speed of a feed roller 112 located on the preceding side to 0. Consequently, a part of a medium on the delaying side can be progressed in the direction A8 perpendicular to the medium conveying direction while keeping a part of the medium on the preceding side at the position, and therefore a skew of the medium can be more reliably corrected. Alternatively, the control module 171 may set both of circumferential speeds of a plurality of feed rollers 112*a* and 112*b* to mutually different values greater than 0. Consequently, the control module 171 can convey a medium while correcting a skew of the medium and therefore can convey the medium in a shorter period.

On the other hand, when the skew flag is ON in step S303, the control module 171 determines whether or not skew correction of a medium is successful based on each passage time detected in step S302 (step S310). The control module 171 determines successful skew correction of the medium when the front edge of the medium passes the first center sensor 115 within a second predetermined time from a start of the skew correction in step S309. The control module 171 may determine successful skew correction of the medium when the front edge of the medium passes a side sensor located on the side where progression of the medium is delayed within a second predetermined time from a start of the skew correction in step S309. For example, the second predetermined time is set to 1 second.

When determining successful skew correction of the medium, the control module 171 stands by until a specified time further elapses (step S311).

When a circumferential speed of a feed roller 112 located on the preceding side is set to a value greater than 0, a part of a medium on the preceding side also progresses during skew correction of the medium. During a time T from a start of skew correction to a time when a part of the medium on the delaying side passes the first center sensor 115 etc., the part of the medium on the preceding side progresses by a distance ($V_A \times T$) acquired by multiplying a circumferential speed $V_A$ of the feed roller 112 located on the preceding side by the time T. The difference between the part of the medium on the delaying side and the part of the medium on the preceding side shortens at a speed ($V_B - V_A$) acquired by subtracting the circumferential speed $V_A$ of the feed roller 112 located on the preceding side from a circumferential speed $V_B$ of a feed roller 112 located on the delaying side.

Accordingly, even after the first center sensor 115 etc., detects the medium, the control module 171 rotates each feed roller 112 at a set circumferential speed and continues the skew correction of the medium until a specified time calculated by equation (1) below elapses.

$$(\text{Specified time}) = (V_A \times T)/(V_B - V_A) \quad (1)$$

Consequently, the control module 171 can cause the part of the medium on the delaying side to catch up with the part of the medium on the preceding side. The processing in step S311 may be omitted.

Next, the control module 171 resets the circumferential speed of each feed roller 112 to the original circumferential speed and ends the skew correction of the medium (step S312); and then ends the series of steps. Thus, when a skew is determined to be occurring, the control module 171 makes the circumferential speeds of the feed rollers 112*a* and 112*b* mutually different at least until the first center sensor 115 detects the medium. Particularly, when a skew is determined to be occurring, the control module 171 makes the circumferential speeds of the feed rollers 112*a* and 112*b* mutually different until a specified time elapses after the first center sensor 115 detects the medium.

On the other hand, when not determining successful skew correction of the medium in step S308, the control module 171 determines whether or not a second predetermined time elapses after a start of the skew correction of the medium (step S313). When the second predetermined time has not yet elapsed from the start of the skew correction of the medium, the control module 171 moves the processing to step S301.

On the other hand, when the second predetermined time has elapsed after the start of the skew correction of the medium, the control module 171 determines failure of the skew correction of the medium (step S314).

Next, the control module 171 changes an imaging range in the medium conveying direction A1 by the imaging device 121 (step S315) and ends the series of steps.

As described above, when a skew of a medium is not occurring, the imaging device 121 starts imaging when the front edge of the medium passes the position of the second center sensor 120 and ends the imaging when a predetermined period elapses after the rear edge of the medium passes the position of the second center sensor 120. However, when a skew of the medium is occurring, a preceding part of the medium may reach the position of the imaging device 121 when the front edge of the medium passes the position of the second center sensor 120. Further, when the predetermined period elapses after the rear edge of the medium passes the position of the second center sensor 120, a delaying part of the medium may be remaining at the position of the imaging device 121.

Accordingly, the control module 171 makes an imaging range in the medium conveying direction A1 by the imaging device 121 wider than an imaging range when a skew of a medium is not occurring. For example, the control module 171 causes the imaging device 121 to start imaging before the front edge of a medium passes the position of the second center sensor 120, that is, for example, immediately after determining failure of skew correction of the medium. Further, the control module 171 causes the imaging device 121 to end the imaging when a second predetermined period longer than the predetermined period elapses after the rear edge of the medium passes the position of the second center sensor 120. Consequently, the control module 171 can cause the imaging device 121 to image the medium in such a way that the entire skewed medium is included in an input image.

The medium conveying apparatus 100 may detect a skew of a medium by use of encoders as the first center sensor 115, the first side sensor 116, and the second side sensor 117. In that case, the medium conveying apparatus 100 includes a plurality of encoders being located between the feed rollers 112 and the first conveyance rollers 118 in the medium conveying direction A1 and also being spaced and located alongside in the direction A8 perpendicular to the medium conveying direction. Each encoder includes a disk on which a large number of slits (light transmission holes) are formed, the disk being provided to rotate according to a conveyed medium, and a light emitter and a light receiver provided to face one another with the disk in between. Each light receiver detects a movement distance of a medium at certain intervals based on a changeover count between a state in which a slit exists between each light emitter and each light receiver, and a state in which a slit does not exist and light is blocked by the disk. When a movement distance detected by each encoder exceeds a threshold value, the skew detection module 174 determines that the medium passes the position.

As described in detail above, the medium conveying apparatus 100 determines that a skew is occurring when the first center sensor 115 located in a central part does not detect a medium within a predetermined time after either of the two side sensors located on both sides detects the medium. Then, the medium conveying apparatus 100 corrects the skew at least until the first center sensor 115 detects the medium. By detecting a skew by use of three sensors, the medium conveying apparatus 100 can prevent erroneous correction of a skew and increase in a tilt of a fed medium when a corner of the medium is conveyed between the two side sensors. Accordingly, the medium conveying apparatus 100 can more precisely detect and more satisfactorily correct a skew of a medium, and consequently can more suitably convey the medium.

Consequently, the medium conveying apparatus 100 can suppress failure in imaging an entire medium or occurrence of a medium jam. Furthermore, by detecting and automatically correcting a skew of a medium before reading the medium, the medium conveying apparatus 100 eliminates a need for a user to re-convey a medium when a skew of the medium occurs and can improve user convenience.

Further, by detecting a skew by use of three sensors, the medium conveying apparatus 100 can correctly detect a direction in which a medium is tilted and correctly correct the tilt of the medium. Further, by detecting a skew by use of three sensors, the medium conveying apparatus 100 can detect and correct a skew of a small medium which does not pass positions of both of the side sensors, a medium not placed at the center of the medium tray 103, or a medium a corner of which is turned down. Accordingly, the medium conveying apparatus 100 can precisely detect and satisfactorily correct skews of various types of media.

Further, the medium conveying apparatus 100 causes the brake rollers 113 to press toward the feed rollers 112 side in such a way that a pressing force of the brake rollers 113 when resetting a fed medium to the medium tray 103 is greater than a pressing force of the brake rollers 113 when feeding a medium. Consequently, the medium conveying apparatus 100 can increase a force for resetting a fed medium to the medium tray 103 and can more suitably restore media when the media multi-feed occurs.

Consequently, a user does not need to take out media from the housing and re-set the media to the medium tray 103 when the media multi-feed occurs, and the medium conveying apparatus 100 can improve user convenience. Further, since re-setting of a medium by a user is not necessary, the medium conveying apparatus 100 can improve a reading processing speed as a whole. Further, the medium conveying apparatus 100 can change a pressing force of the brake rollers 113 without using a special part for changing a pressing force of the brake rollers 113 and can suppress increase in a device size and a device cost.

Figure 19:
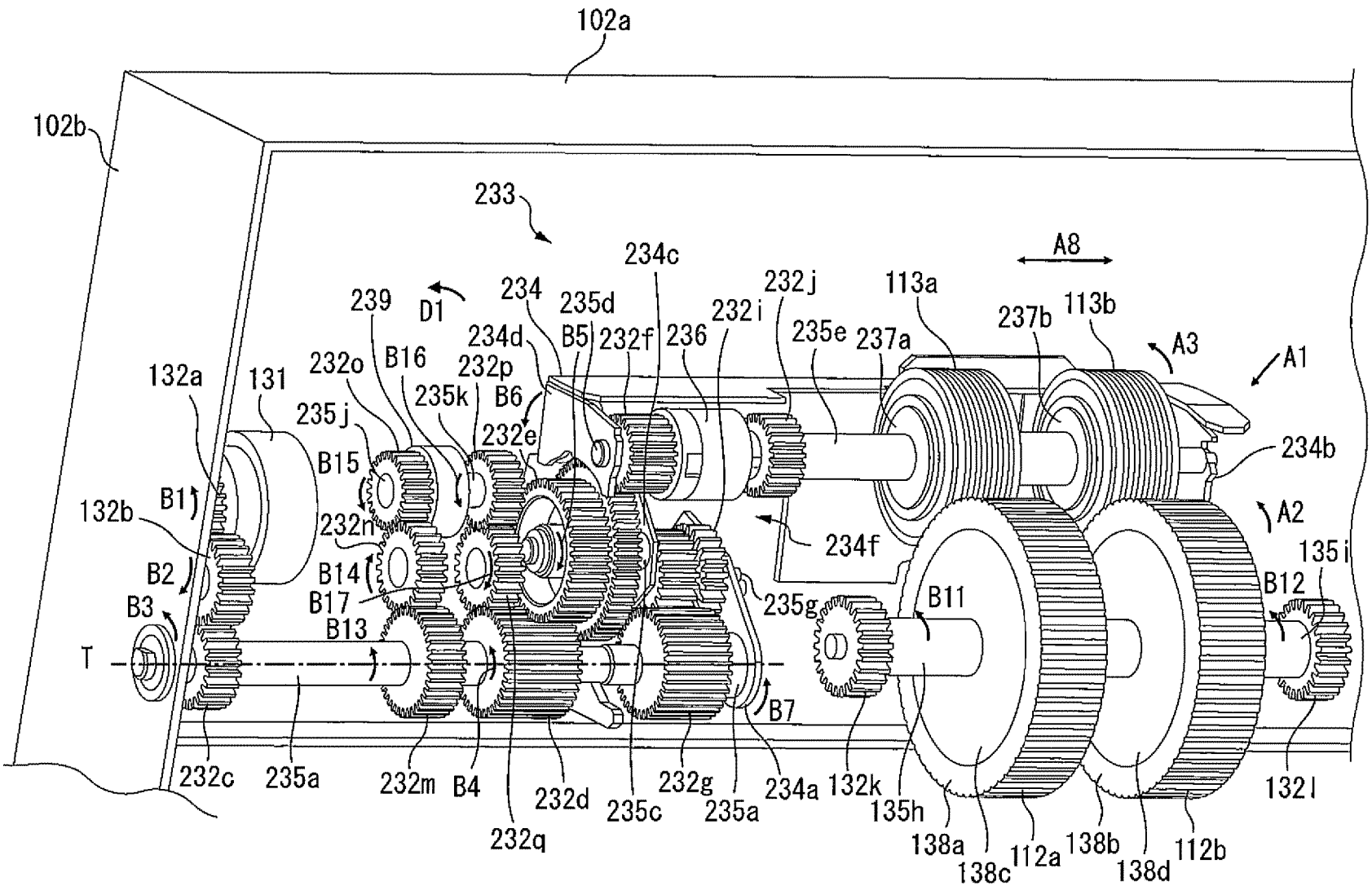
FIG. 19 is a schematic diagram for illustrating another driving mechanism.
Figure 20:
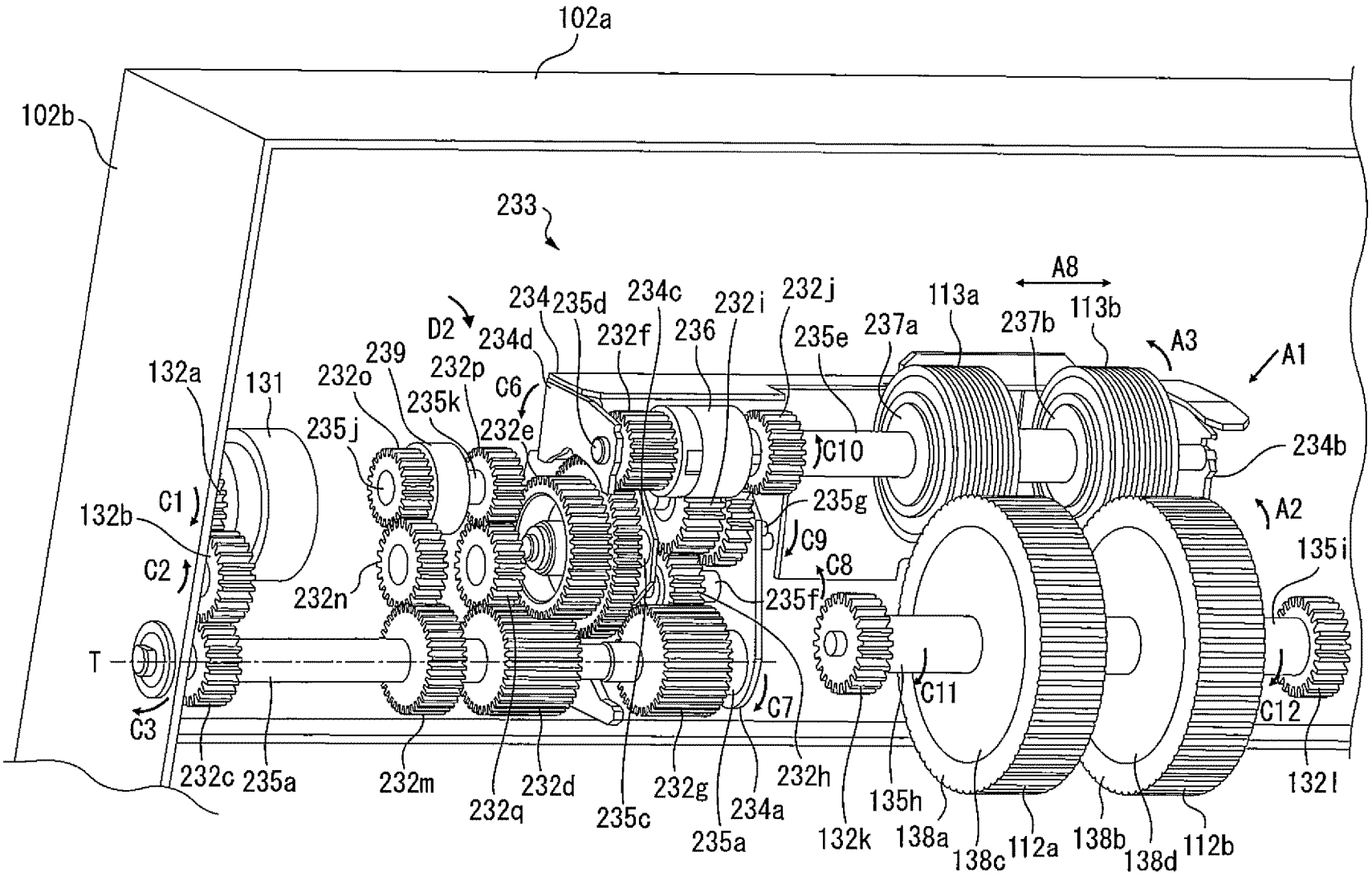
FIG. 20 is a schematic diagram for illustrating the other driving mechanism.

FIG. 19 and FIG. 20 are schematic diagrams for illustrating a driving mechanism of a brake roller 113 in a medium conveying apparatus according to another embodiment. FIG. 19 and FIG. 20 are a perspective view of the driving mechanism of the brake rollers 113 viewed from the conveyance path side, respectively, in a state in which the upper guide 107*b* is removed.

As illustrated in FIG. 19 and FIG. 20, the driving mechanism of the brake rollers 113 according to the present embodiment includes a brake roller unit 233 in place of the brake roller unit 133. The brake roller unit 233 includes third to tenth transmission gears 232*c* to *j*, thirteenth to seventeenth transmission gears 232*m* to *q*, a support member 234, first to seventh shafts 235*a* to *g*, tenth and eleventh shafts 235*j* and *k*, a first torque limiter 236, second torque limiters 237*a* and *b*, and an electromagnetic clutch 239. Although not illustrated, the second shaft 235*b* is provided along a rotation axis T between the internal housing 102*a* and the support member 234, similarly to the second shaft 135*b*, and supports the support member 234 in a rotatable (swingable) manner around the rotation axis T.

The support member 234 has a configuration similar to that of the support member 134. However, although second to fourth sides 234*b* to *d* are formed on the support member 234, a first side 134*a* is not formed. Instead, the brake roller unit 233 includes a first side 234*a* not fixed to the support member 234. The first side 234*a* is mounted on a first side 102*b* of an internal housing 102*a* through the first shaft 235*a*. The first shaft 235*a* is provided along the rotation axis T, and the first side 234*a* is supported by the internal housing 102*a* in a rotatable (swingable) manner around the rotation axis T. Further, a recessed part 234*f* is formed on the support member 234 at a position facing the first side 234*a* and the seventh to ninth transmission gears 232*g* to *i*.

The third transmission gear 232*c* and the fourth transmission gear 232*d* are mounted on the first shaft 235*a*. However, the fourth transmission gear 232*d* is mounted on the first shaft 235*a* through a bearing, etc., in such a way as not to rotate according to rotation of the first shaft 235*a*. The thirteenth transmission gear 232*m* is further mounted on the first shaft 235*a*; and the thirteenth transmission gear 232*m* is engaged with the fourteenth transmission gear 232*n*, and the fourteenth transmission gear 232*n* is engaged with the fifteenth transmission gear 232*o*. The fifteenth transmission gear 232*o* is mounted on the tenth shaft 235*j*. The tenth shaft 235*j* is engaged with the eleventh shaft 235*k* provided on the same axis as the tenth shaft 235*j* through the electromagnetic clutch 239. The sixteenth transmission gear 232*p* is mounted on the eleventh shaft 235*k*; and the sixteenth transmission gear 232*p* is engaged with the seventeenth transmission gear 232*q*, and the seventeenth transmission gear 232*q* is engaged with the fourth transmission gear 232*d*.

Configurations and an arrangement relation of the fifth and sixth transmission gears 232*e* and *f*, the third to fifth shafts 235*c* to *e*, and the first and second torque limiters 236 and 237*a* and *b* are similar to the configurations and the arrangement relation of the fifth and sixth transmission gears 132*e* and *f*, the third to fifth shafts 135*c* to *e*, and the first to second torque limiters 136 and 137*a* and *b*.

Further, the seventh transmission gear 232*g* is mounted on the first shaft 235*a*. However, the seventh transmission gear 232*g* is mounted on the first shaft 235*a* bypassing a one-way clutch, in such a way as to rotate according to rotation of the first shaft 235*a*. An arrangement relation of the seventh to ninth transmission gears 232*g* to *i* and the sixth and seventh shafts 235*f* and *g* with respect to the first side 234*a* is similar to the arrangement relation of the seventh to ninth transmission gears 132*g* to *i* and the sixth and seventh shafts 135*f* and *g* with respect to the first side 134*a*. The ninth transmission gear 232*i* is engaged with the tenth transmission gear 232*j*, and the tenth transmission gear 232*j* is mounted on the fifth shaft 235*e*.

Figure 21A:
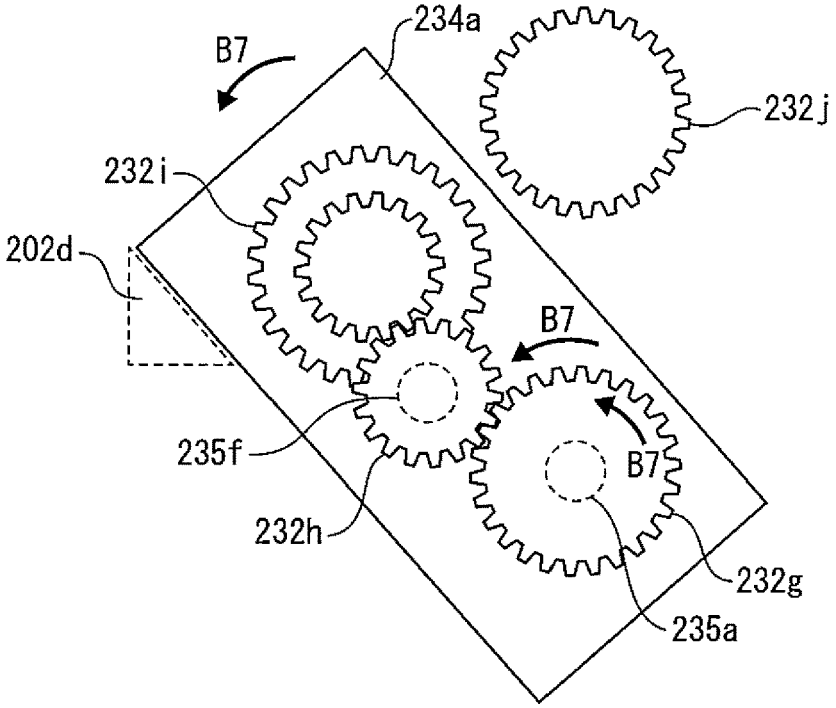
FIG. 21A is a schematic diagram for illustrating a movement of a first side 234*a*.
Figure 21B:
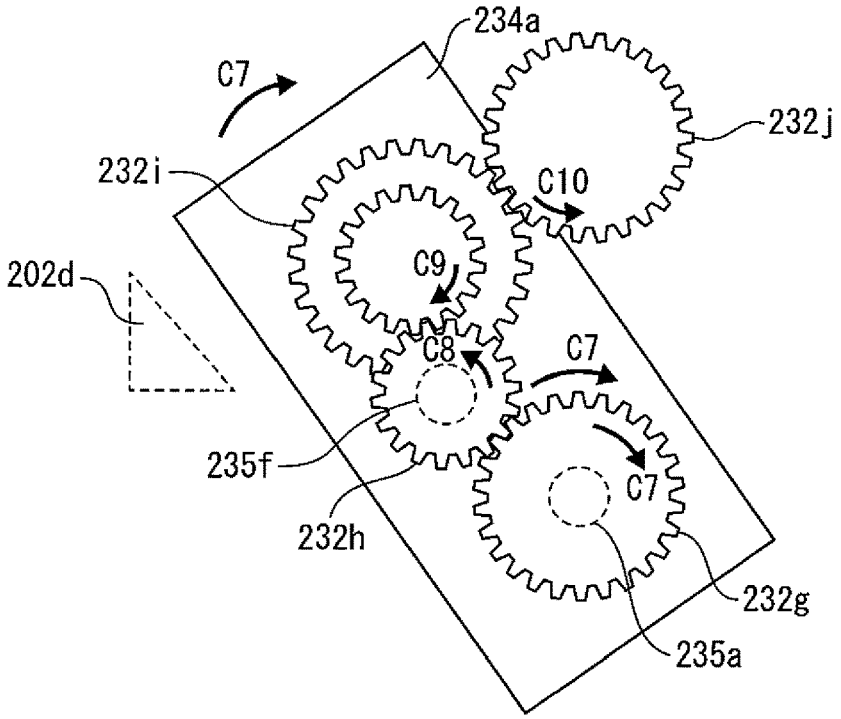
FIG. 21B is a schematic diagram for illustrating a movement of the first side 234*a*.

FIG. 21A and FIG. 21B are schematic diagrams for illustrating movements of the first side 234*a*. Each of FIG. 21A and FIG. 21B is a schematic diagram of the first side 234*a* viewed from side. FIG. 21A illustrates a state of the first side 234*a* when the seventh transmission gear 232*g* rotates in a direction of an arrow B7, and FIG. 21B illustrates a state of the first side 234*a* when the seventh transmission gear 232*g* rotates in a direction of an arrow C7.

As illustrated in FIG. 21A, when the seventh transmission gear 232*g* rotates in the direction of the arrow 137, the eighth transmission gear 232*h* engaged with the seventh transmission gear 232*g* moves (revolves) in the direction of the arrow B7 according to the rotation of the seventh transmission gear 232*g*. The first side 234*a* mounted with the sixth shaft 235*f* being a rotation axis of the eighth transmission gear 232*h* rotates around the rotation axis T of the first shaft 235*a* in the direction of the arrow B7 according to the movement of the eighth transmission gear 232*h*. The first side 234*a* stops at a position where the first side 234*a* comes into contact with a stopper 202*d* provided on the internal housing 102*a*. Consequently, the ninth transmission gear 232*i* separates from the tenth transmission gear 232*j*. Consequently, the eighth transmission gear 232*h* and the ninth transmission gear 232*i* respectively rotate according to the rotation of the seventh transmission gear 232*g*; however, a driving force caused by the rotation is not transmitted to the tenth transmission gear 232*j*.

On the other hand, as illustrated in FIG. 21B, when the seventh transmission gear 232*g* rotates in the direction of the arrow C7, the eighth transmission gear 232*h* engaged with the seventh transmission gear 232*g* moves (revolves) in the direction of the arrow C7 according to the rotation of the seventh transmission gear 232*g*. The first side 234*a* mounted with the sixth shaft 235*f* being the rotation axis of the eighth transmission gear 232*h* rotates around the rotation axis T of the first shaft 235*a* in the direction of the arrow C7 according to the movement of the eighth transmission gear 232*h*. The first side 234*a* stops at a position where a gear part of the ninth transmission gear 232*i* with a larger outer diameter engages with the tenth transmission gear 232*j*. Consequently, the ninth transmission gear 232*i* engages with the tenth transmission gear 232*j*. Accordingly, the eighth transmission gear 232*h*, the ninth transmission gear 232*i*, and the tenth transmission gear 232*j* rotate in directions of arrows C8 to C10 according to the rotation of the seventh transmission gear 232*g*, respectively. Thus, the seventh transmission gear 232*g* functions as a sun gear, and the eighth transmission gear 232*h* and the ninth transmission gear 232*i* function as planetary gears.

FIG. 19 illustrates a state of the brake roller unit 233 when the first motor 131 generates a first driving force. When the first motor 131 generates the first driving force, the electromagnetic clutch 239 is set to a connected state. In this case, the third transmission gear 232*c* and the first shaft 235*a* rotate in a direction of an arrow B3; and the thirteenth to seventeenth transmission gears 232*m* to *q* accordingly rotate in directions of arrows B13 to B17, respectively, and the fourth to sixth transmission gears 232*d* to *f* rotate in directions of arrows B4 to B6, respectively. Consequently, the brake rollers 113 rotate in a direction A3 opposite to a medium feeding direction. By the first shaft 235*a* rotating in the direction of the arrow B3, the seventh transmission gear 232*g* rotates in the direction of the arrow B7, and the ninth transmission gear 232*i* separates from the tenth transmission gear 232*j*. Consequently, the first driving force is not transmitted through the seventh to ninth transmission gears 232*g* to *i*.

FIG. 20 illustrates a state of the brake roller unit 233 when the first motor 131 generates a second driving force. When the first motor 131 generates the second driving force, the electromagnetic clutch 239 is set to a disconnected state. In this case, the third transmission gear 232*c* and the first shaft 235*a* rotate in a direction of an arrow C3, and by the seventh transmission gear 232*g* rotating in the direction of the arrow C7, the ninth transmission gear 232*i* engages with the tenth transmission gear 232*j*. Consequently, the eighth to tenth transmission gears 232*h* to *j* rotate in the directions of the arrows C8 to C10, respectively. Consequently, the brake rollers 113 rotate in the direction A3 opposite to the medium feeding direction. By the tenth transmission gear 232*j* rotating in the direction of the arrow C10, the fourth to sixth transmission gears 232*d* to *f* and the sixteenth and seventeenth transmission gears 232*p* and *q* rotate. On the other hand, by the first shaft 235*a* rotating in the direction of the arrow C3, the thirteenth to fifteenth transmission gears 232*m* to *o* rotate. However, since the electromagnetic clutch 239 is set to the disconnected state, a driving force caused by the rotations is not transmitted.

When the first motor 131 generates the first driving force, a force is applied to the brake rollers 113 in a direction D1 separating from the feed rollers 112 by the brake roller unit 233, similarly to the brake roller unit 133. On the other hand, when the first motor 131 generates the second driving force, the seventh transmission gear 232*g* rotates in the direction of the arrow C7. Consequently, a force rotating around the rotation axis T in the direction of the arrow C7 is applied to the first side 234*a*, and a force is applied to the ninth transmission gear 232*i* in a direction toward the tenth transmission gear 232*j*. Consequently, a pressing force is applied from the ninth transmission gear 232*i* to the tenth transmission gear 232*j*, and a force is applied to the brake rollers 113 in a direction D2 toward the feed rollers 112.

The brake roller unit 233 is an example of a pressing member, according to the present embodiment. Further, the fourth to sixth transmission gears 232*d* to *f* are examples of a first transmission mechanism, the fourth transmission gear 232*d* is an example of a first gear, and the fifth transmission gear 232*e* is an example of a second gear. On the other hand, the seventh to tenth transmission gears 232*g* to *j* are examples of a second transmission mechanism, the seventh transmission gear 232*g* is an example of a third gear, and the eighth transmission gear 232*h* and the ninth transmission gear 232*i* are examples of a fourth gear. Further, the eighth transmission gear 232*h* and the ninth transmission gear 232*i* are examples of a planetary gear. By connection of the eighth transmission gear 232*h* and the ninth transmission gear 232*i* being changed in response to switching from the first driving force to the second driving force, the second transmission mechanism transmits the second driving force to the brake rollers 113, bypassing the first torque limiter 236. A planetary gear may be provided on the first transmission mechanism side transmitting the first driving force, rather than being provided on the second transmission mechanism side transmitting the second driving force.

As described in detail above, even in a case of a planetary gear being used in the driving mechanism of the brake rollers 113, the medium conveying apparatus can more suitably restore media when the media multi-feed occurs.

Figure 22A:
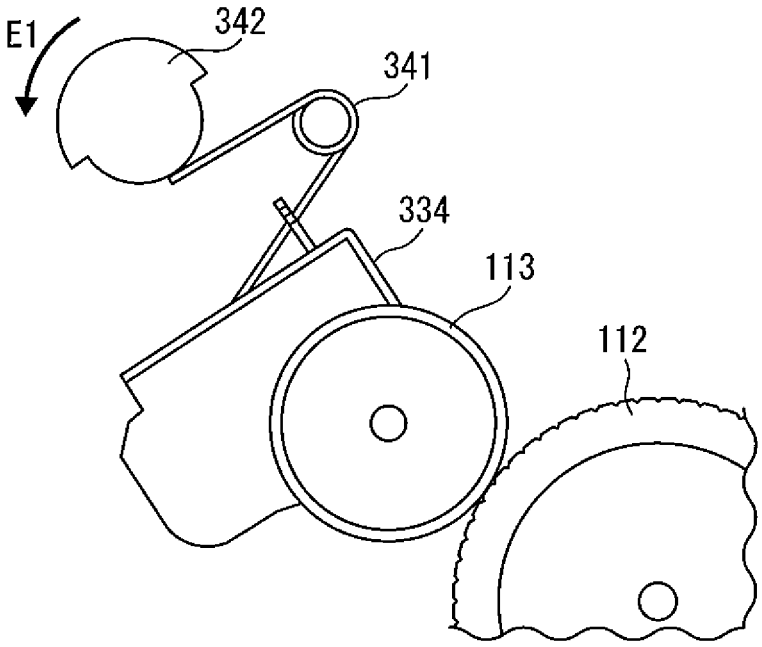
FIG. 22A is a schematic diagram for illustrating a configuration of other brake rollers 113.
Figure 22B:
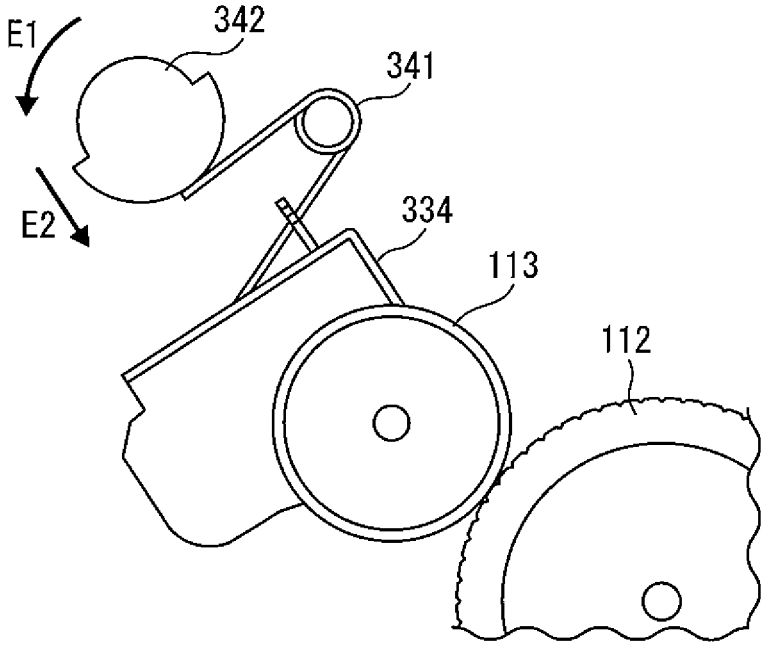
FIG. 22B is a schematic diagram for illustrating the configuration of the other brake rollers 113.

FIG. 22A and FIG. 22B are schematic diagrams for illustrating a configuration of brake rollers 113 in a medium conveying apparatus according to yet another embodiment.

As illustrated in FIG. 22A and FIG. 22B, the medium conveying apparatus according to the present embodiment includes a support member 334, an elastic member 341, and a cam 342. The support member 334 supports the brake rollers 113. The elastic member 341 is a spring, a rubber, etc., and presses the brake rollers 113 to a feed rollers 112 side through the support member 334. The cam 342 is provided to be rotatable in a direction of an arrow E1 according to a driving force from a driving device and presses the elastic member 341 to the brake rollers 113 side. Then, a control module changes a pressing force of the brake rollers 113 by rotating the cam 342. The elastic member 341 and the cam 342 are examples of pressing members, according to the present embodiment.

FIG. 22A illustrates a state of a brake roller unit 233 when a first motor 131 generates a first driving force. When the first motor 131 generates the first driving force, the cam 342 is located in such a way that a pressing force by the elastic member 341 is decreased. Consequently, a pressing force of the brake rollers 113 decreases.

FIG. 22B illustrates a state of the brake roller unit 233 when the first motor 131 generates a second driving force. When the first motor 131 generates the second driving force, the cam 342 is located in such a way that the elastic member 341 presses the support member 334 in a direction of an arrow E2. Consequently, the support member 334 is pressed in the direction of the arrow E2, and the pressing force of the brake rollers 113 increases.

The medium conveying apparatus may press the brake rollers 113 to the feed rollers 112 side by use of another means, such as a solenoid, as a pressing member in place of the elastic member 341 and the cam 342. In that case, the control module changes the pressing force of the brake rollers 113 by moving the solenoid.

As described in detail above, even in a case of using a cam, a solenoid, etc., the medium conveying apparatus can more suitably restore media when the media multi-feed occurs.

Figure 23:
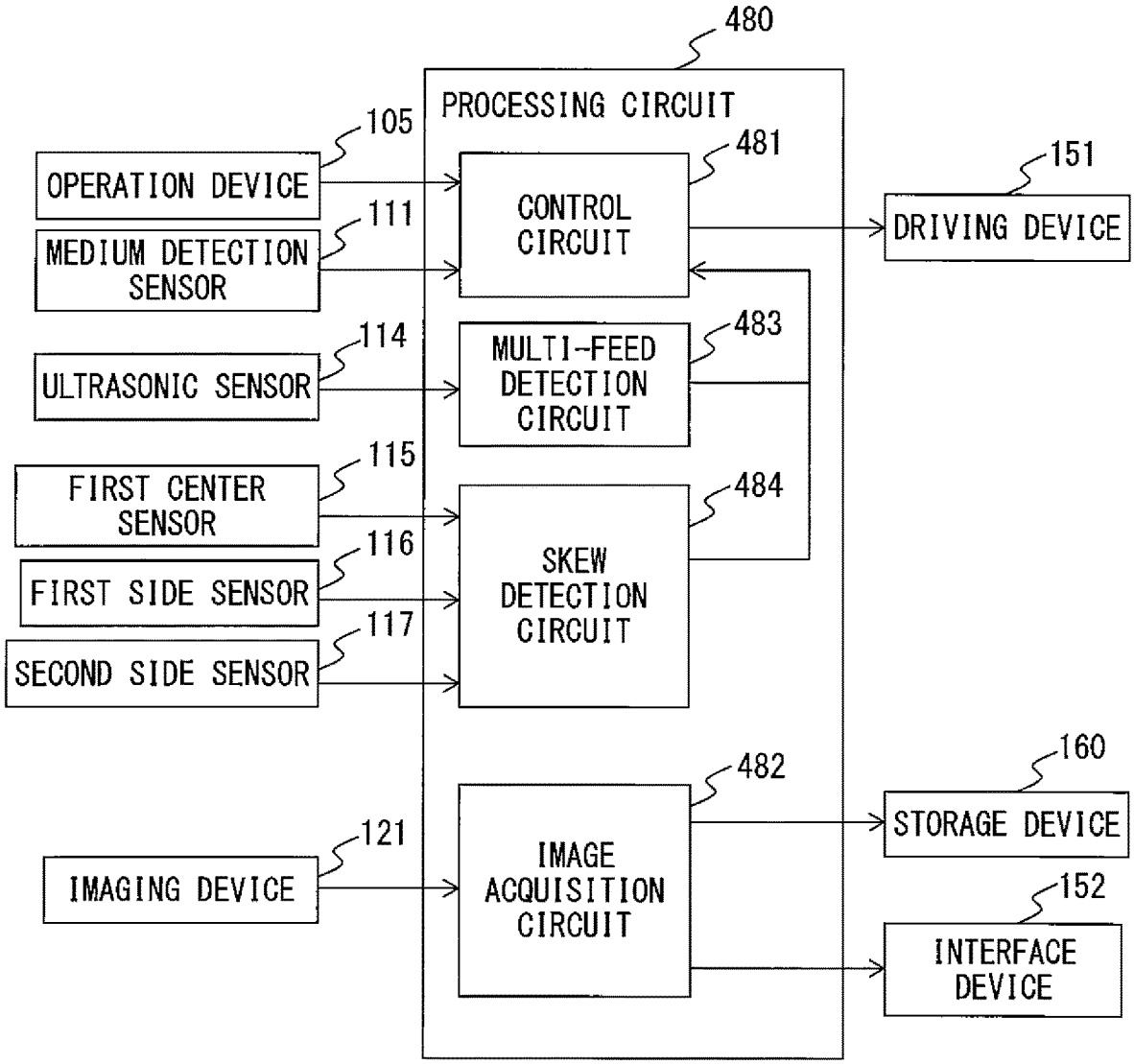
FIG. 23 is a diagram illustrating a schematic configuration of yet another processing circuit 480.

FIG. 23 is a diagram illustrating a schematic configuration of a processing circuit 480 in a medium conveying apparatus according to yet another embodiment. The processing circuit 480 is used in place of the processing circuit 170 in the medium conveying apparatus 100 and executes the medium reading processing, the multi-feed detection processing, and the skew detection processing in place of the processing circuit 170. The processing circuit 480 includes a control circuit 481, an image acquisition circuit 482, a multi-feed detection circuit 483, and a skew detection circuit 484.

The control circuit 481 is an example of a control module and has a function similar to the control module 171. The control circuit 481 receives an operation signal from an operation device 105, a medium detection signal from a medium detection sensor 111, a detection result of media multi-feed from the multi-feed detection circuit 483, and a detection result of a skew of a medium from the skew detection circuit 484. The control circuit 481 drives a driving device 151 based on each received signal and also when a skew of a medium is detected, corrects the skew of the medium by controlling the driving device 151 in such a way that circumferential speeds of feed rollers 112*a* and 112*b* are mutually different. Further, when the media multi-feed is detected, the control circuit 481 controls a brake roller unit 133 through the driving device 151 in such a way that a pressing force of brake rollers 113 increases.

The image acquisition circuit 482 is an example of an image acquisition module and has a function similar to the image acquisition module 172. The image acquisition circuit 482 receives an input image from an imaging device 121 and stores the input image into a storage device 160, and also transmits the input image to an information processing device through an interface device 152.

The multi-feed detection circuit 483 is an example of a multi-feed detection module and has a function similar to the multi-feed detection module 173. The multi-feed detection circuit 273 receives an ultrasonic signal from an ultrasonic sensor 114, detects the media multi-feed based on the ultrasonic signal, and outputs the detection result to the control circuit 481.

The skew detection circuit 484 is an example of a skew detection module and has a function similar to the skew detection module 174. The skew detection circuit 484 receives a first center signal from a first center sensor 115, a first side signal from a first side sensor 116, and a second side signal from a second side sensor 117. The skew detection circuit 484 detects a skew of a medium based on each received signal and outputs the detection result to the control circuit 481.

As described in detail above, even when using the processing circuit 480, the medium conveying apparatus can more suitably convey a medium and also when the media multi-feed occurs, can more suitably restore the media.

Each part included in the processing circuit may be independently configured with an integrated circuit, a microprocessor, firmware, etc. Further, some parts included in the processing circuit may be configured with a circuit, and other parts may be configured with a functional module implemented by software operating on a processor.

According to this embodiment, the medium conveying apparatus, the method, and the computer-readable, non-transitory medium storing the control program can more suitably restore media when media multi-feed occurs.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a medium tray;

a feed roller to feed a medium placed on the medium tray;

a brake roller facing the feed roller;

a pressing member to press the brake roller to a side of the feed roller;

a processor to determine media multi-feed, and control the feed roller and the brake roller in such a way that the medium is reset to the medium tray when the media multi-feed is detected, wherein the processor controls the pressing member in such a way that a pressing force of the brake roller when resetting the medium to the medium tray is greater than a pressing force of the brake roller when feeding the medium, and a pressing force of the brake roller when refeeding the medium reset to the medium tray is smaller than a pressing force of the brake roller when resetting the medium to the medium tray.

2. The medium conveying apparatus according to claim 1, further comprising a motor for generating a driving force, wherein the pressing member includes:

a first transmission mechanism including a first gear to rotate in a first direction and a second gear to apply a force to the brake roller in the first direction according to rotation of the first gear, to transmit the driving force to the brake roller; and a second transmission mechanism including a third gear to rotate in a second direction opposite to the first direction and a fourth gear to apply a force to the brake roller in the second direction according to rotation of the third gear, to transmit the driving force to the brake roller, and the processor changes a pressing force of the brake roller by switching between the first transmission mechanism and the second transmission mechanism.

3. The medium conveying apparatus according to claim 1, wherein the pressing member includes:

an elastic member to press the brake roller to the feed roller side; and a cam to press the elastic member to the brake roller side, and wherein the processor changes a pressing force of the brake roller by rotating the cam.

4. The medium conveying apparatus according to claim 1, wherein the feed roller is provided to rotate in a medium feeding direction when feeding the medium, the brake roller is provided to rotate in a direction opposite to the medium feeding direction or stop, when feeding the medium, and the feed roller and the brake roller are provided to rotate in the direction opposite to the medium feeding direction when resetting the medium to the medium tray.

5. The medium conveying apparatus according to claim 1, further comprising:

a motor to generate a driving force;

a first transmission mechanism to transmit the driving force to the brake roller through a first torque limiter, a torque limit value of which is a first limit value; and a second transmission mechanism to transmit the driving force to the brake roller bypassing the first torque limiter and also through a second torque limiter, a torque limit value of which is a second limit value greater than the first limit value, wherein the first torque limiter and the second torque limiter are provided on a rotation axis of the brake roller.

6. The medium conveying apparatus according to claim 5, wherein, the motor generates a first driving force by rotation in a first direction, as the driving force, and generates a second driving force by rotation in a second direction opposite to the first direction, as the driving force, the first transmission mechanism or the second transmission mechanism includes a planetary gear, and the second transmission mechanism transmits the second driving force to the brake roller bypassing the first torque limiter, by connection of the planetary gear being changed in response to switching from the first driving force to the second driving force.

7. The medium conveying apparatus according to claim 1, wherein the feed roller sequentially feeds a medium placed on a medium tray from a lower side.

8. A method for controlling feeding a medium, comprising:

feeding a medium placed on a medium tray by a feed roller;

pressing a brake roller facing the feed roller to a side of the feed roller by a pressing member;

detecting media multi-feed;

controlling the feed roller and the brake roller in such a way that the medium is reset to the medium tray when the media multi-feed is detected; and controlling the pressing member in such a way that a pressing force of the brake roller when resetting the medium to the medium tray is greater than a pressing force of the brake roller when feeding the medium, and a pressing force of the brake roller when refeeding the medium reset to the medium tray is smaller than a pressing force of the brake roller when resetting the medium to the medium tray.

9. The method according to claim 8, further comprising generating a driving force by a motor, wherein the pressing member includes:

a first transmission mechanism including a first gear to rotate in a first direction and a second gear to apply a force to the brake roller in the first direction according to rotation of the first gear, to transmit the driving force to the brake roller; and a second transmission mechanism including a third gear to rotate in a second direction opposite to the first direction and a fourth gear to apply a force to the brake roller in the second direction according to rotation of the third gear, to transmit the driving force to the brake roller, and wherein a pressing force of the brake roller is changed by switching between the first transmission mechanism and the second transmission mechanism, in the pressing member controlling step.

10. The method according to claim 8, wherein the pressing member includes:

an elastic member to press the brake roller to the feed roller side; and a cam to press the elastic member to the brake roller side, and wherein a pressing force of the brake roller is changed by rotating the cam, in the pressing member controlling step.

11. The method according to claim 8, wherein the feed roller is provided to rotate in a medium feeding direction when feeding the medium, the brake roller is provided to rotate in a direction opposite to the medium feeding direction or stop, when feeding the medium, and the feed roller and the brake roller are provided to rotate in the direction opposite to the medium feeding direction when resetting the medium to the medium tray.

12. The method according to claim 8, further comprising:

generating a driving force by a motor;

transmitting the driving force to the brake roller through a first torque limiter, a torque limit value of which is a first limit value by a first transmission mechanism; and transmitting the driving force to the brake roller bypassing the first torque limiter and also through a second torque limiter, a torque limit value of which is a second limit value greater than the first limit value by a second transmission mechanism, wherein the first torque limiter and the second torque limiter are provided on a rotation axis of the brake roller.

13. The method according to claim 12, wherein, a first driving force is generated by rotation in a first direction, as the driving force, and a second driving force is generated by rotation in a second direction opposite to the first direction, as the driving force, by the motor, in the generating step, wherein the first transmission mechanism or the second transmission mechanism includes a planetary gear, and wherein the second driving force is transmitted to the brake roller bypassing the first torque limiter, by connection of the planetary gear being changed in response to switching from the first driving force to the second driving force, in the transmitting step by the second transmission mechanism.

14. The method according to claim 8, wherein a medium placed on a medium tray is sequentially fed from a lower side by the feed roller, in the feeding step.

15. A computer-readable, non-transitory medium storing a computer program, wherein the computer program causes a medium conveying apparatus including a medium tray, a feed roller to feed a medium placed on the medium tray, a brake roller facing the feed roller, and a pressing member to press the brake roller to a side of the feed roller, to execute a process, the process comprising:

determining media multi-feed, controlling the feed roller and the brake roller in such a way that the medium is reset to the medium tray when the media multi-feed is detected, and controlling the pressing member in such a way that a pressing force of the brake roller when resetting the medium to the medium tray is greater than a pressing force of the brake roller when feeding the medium, and a pressing force of the brake roller when refeeding the medium reset to the medium tray is smaller than a pressing force of the brake roller when resetting the medium to the medium tray.

16. The computer-readable, non-transitory medium according to claim 15, wherein the medium conveying apparatus further includes a motor for generating a driving force, wherein the pressing member includes:

a first transmission mechanism including a first gear to rotate in a first direction and a second gear to apply a force to the brake roller in the first direction according to rotation of the first gear, to transmit the driving force to the brake roller; and a second transmission mechanism including a third gear to rotate in a second direction opposite to the first direction and a fourth gear to apply a force to the brake roller in the second direction according to rotation of the third gear, to transmit the driving force to the brake roller, and wherein a pressing force of the brake roller is changed by switching between the first transmission mechanism and the second transmission mechanism, in the pressing member controlling step.

17. The computer-readable, non-transitory medium according to claim 15, wherein the pressing member includes:

an elastic member to press the brake roller to the feed roller side; and a cam to press the elastic member to the brake roller side, and wherein a pressing force of the brake roller is changed by rotating the cam, in the pressing member controlling step.

18. The computer-readable, non-transitory medium according to claim 15, wherein the feed roller is provided to rotate in a medium feeding direction when feeding the medium, the brake roller is provided to rotate in a direction opposite to the medium feeding direction or stop, when feeding the medium, and the feed roller and the brake roller are provided to rotate in the direction opposite to the medium feeding direction when resetting the medium to the medium tray.

19. The computer-readable, non-transitory medium according to claim 15, wherein the medium conveying apparatus further includes a motor to generate a driving force, a first transmission mechanism to transmit the driving force to the brake roller through a first torque limiter, a torque limit value of which is a first limit value, and a second transmission mechanism to transmit the driving force to the brake roller bypassing the first torque limiter and also through a second torque limiter, a torque limit value of which is a second limit value greater than the first limit value, wherein the first torque limiter and the second torque limiter are provided on a rotation axis of the brake roller.

20. The computer-readable, non-transitory medium according to claim 19, wherein the motor generates a first driving force by rotation in a first direction, as the driving force, and generates a second driving force by rotation in a second direction opposite to the first direction, as the driving force, wherein the first transmission mechanism or the second transmission mechanism includes a planetary gear, and wherein the second transmission mechanism transmits the second driving force to the brake roller bypassing the first torque limiter, by connection of the planetary gear being changed in response to switching from the first driving force to the second driving force.

* * * * *